US011892203B2

(12) United States Patent
Bush

(10) Patent No.: US 11,892,203 B2
(45) Date of Patent: Feb. 6, 2024

(54) METHOD OF OPERATING REFRIGERATION CYCLE DEVICE

(71) Applicant: Mitsubishi Electric US, Inc., Cypress, CA (US)

(72) Inventor: Joseph Paul Bush, Lawrenceville, GA (US)

(73) Assignee: MITSUBISHI ELECTRIC US, INC., Cypress, CA (US)

( * ) Notice: Subject to any disclaimer, the term of this patent is extended or adjusted under 35 U.S.C. 154(b) by 0 days.

(21) Appl. No.: 17/498,311

(22) Filed: Oct. 11, 2021

(65) Prior Publication Data

US 2022/0042725 A1 Feb. 10, 2022

Related U.S. Application Data

(62) Division of application No. 16/984,732, filed on Aug. 4, 2020, now Pat. No. 11,175,074.

(51) Int. Cl.
*F25B 13/00* (2006.01)
*F25B 41/20* (2021.01)

(52) U.S. Cl.
CPC ..... *F25B 13/00* (2013.01); *F25B 41/20* (2021.01)

(58) Field of Classification Search
CPC .... F25B 13/00; F25B 41/20; F25B 2313/003; F25B 2339/047; F25B 2700/19;
(Continued)

(56) References Cited

U.S. PATENT DOCUMENTS 3,913,347 A * 10/1975 Stevens ..... F25B 49/02 62/227
9,897,349 B2 2/2018 Tamaki et al.
(Continued)

FOREIGN PATENT DOCUMENTS

CN 102168898 A 8/2011
CN 20394933 U 11/2014
(Continued)

OTHER PUBLICATIONS

J. J. Tomlinson, C. K. Rice, Ph. D., E. Baskin, Ph. D. (May 2005). Integrated Heat Pumps for Combined Space Conditioning and Water Heating. Oak Ridge National Laboratory.
(Continued)

*Primary Examiner* — Marc E Norman
(74) *Attorney, Agent, or Firm* — POSZ LAW GROUP, PLC

(57) ABSTRACT

A refrigeration cycle device, comprising: a compressor configured to compress a refrigerant; an outdoor air heat exchanger configured to exchange heat between the refrigerant and outside air located outside a target space; an indoor air heat exchanger configured to exchange heat between the refrigerant and inside air located inside the target space; a water heat exchanger configured to exchange heat between the refrigerant and water; a four-way valve located between an indoor port on the indoor air heat exchanger, an outdoor port on the outdoor air heat exchanger, an input port on the compressor, and an output port on the compressor; a bypass refrigerant line connecting the indoor port to the outdoor port; and a controllable valve located on the bypass refrigerant line, the controllable valve being configured to have an open state that passes the refrigerant and a closed state that prohibits passage of the refrigerant.

7 Claims, 16 Drawing Sheets

(58) Field of Classification Search
CPC ..... F25B 2700/21; F25B 2700/2103; F25B 2700/21151; F25B 2700/21152; F25B 2700/2116; F25B 2700/21162; F25B 2700/21163; F25B 2700/21174; F25B 2700/21175
See application file for complete search history.

(56) References Cited

U.S. PATENT DOCUMENTS

| | | | | |
|---|---|---|---|---|
| 2005/0109490 | A1* | 5/2005 | Harmon | F25B 49/027 165/133 |
| 2013/0167559 | A1 | 7/2013 | Kim et al. | |
| 2018/0010829 | A1* | 1/2018 | Taras | F25B 30/02 |
| 2018/0328635 | A1* | 11/2018 | Tashiro | F25B 41/26 |
| 2019/0072284 | A1* | 3/2019 | Ushijima | F25B 41/20 |
| 2020/0072510 | A1* | 3/2020 | Brown | F25B 29/003 |
| 2021/0018234 | A1* | 1/2021 | Lingrey | F25B 40/04 |

FOREIGN PATENT DOCUMENTS

| | | | |
|---|---|---|---|
| CN | 204128105 | U | 1/2015 |
| CN | 104864627 | A | 8/2015 |
| KR | 20120117527 | A | 10/2012 |
| WO | 2011/113295 | A1 | 9/2011 |

OTHER PUBLICATIONS

A Aziz, Thalal, I Amri, Herisiswanto, &; A K Mainil. (Sep. 1, 2017). Effect of heat recovery water heater system on the performance of residential split air conditioner using hydrocarbon refrigerant(HCR22). IOP Conf. Series: Materials Science and Engineering, 237, 012010.

R.B. Lokapure & J.D. Joshi. (Dec. 2012). Waste Heat Recovery through Air Conditioning System. International Journal of Engineering Research and Development, 5(3), 89-92.

* cited by examiner

METHOD OF OPERATING REFRIGERATION CYCLE DEVICE

CROSS REFERENCE TO RELATED APPLICATION

This application is a divisional of U.S. application Ser. No. 16/984,732 filed on Aug. 4, 2020, the disclosure of which is incorporated herein by reference.

TECHNICAL FIELD

The disclosed devices and methods relate generally to a refrigeration cycle device and a method of operating the same. More particularly, the disclosed devices and methods relate to a refrigeration cycle device that can heat water in a water heater using waste heat during an air-cooling operation.

BACKGROUND

A heating, ventilation, and air conditioning (HVAC) system operates by exchanging heat between refrigerant and inside air to condition the inside air and by exchanging heat between refrigerant and outside air to either dissipate heat or absorb heat. This exchange of heat is performed using a refrigerant that is circulated through the HVAC system, absorbs heat during one part of a refrigeration cycle, and dissipates heat during another part of the refrigeration cycle.

Some HVAC systems can route the refrigerant to a water heater and use the refrigerant to heat water in the water heater. This can save power on the part of the water heater, though it still requires energy from the HVAC system.

However, conventional HVAC systems that provide water heat and space conditioning use a heat exchanger that requires pump energy to circulate water through it. This pump requires energy to operate, which reduces the overall efficiency of the HVAC system. Likewise, conventional HVAC systems that use a heat exchange loop to heat water and air do not provide the ability to also heat and cool a space.

It would therefore be desirable to provide an air-conditioning system that allows for a more efficient water heating operation, particularly one that does not require the presence or operation of a pump.

SUMMARY OF THE INVENTION

According to one or more embodiments, a refrigeration cycle device is provided, comprising: a compressor configured to receive a refrigerant at a compressor input port, compress the refrigerant, and pass the compressed refrigerant from a compressor output port; an outdoor air heat exchanger having a first outdoor port and a second outdoor port, configured to exchange heat between the refrigerant passing between the first and second outdoor ports and outside air located outside a target space; an indoor air heat exchanger having a first indoor port and a second indoor port, configured to exchange heat between the refrigerant passing between the first and second indoor ports and inside air located inside the target space; a water heat exchanger having a first refrigerant port and a second refrigerant port, configured to exchange heat between the refrigerant passing between the first and second refrigerant ports and water; a four-way valve located between the first indoor port, the first outdoor port, the compressor input port, and the compressor output port, the four-way valve being configured to selectively either connect the first indoor port to the compressor input port and the first outdoor port to the compressor output port, or to connect the first outdoor port to the compressor input port and the first indoor port to the compressor output port; a first bypass refrigerant line connecting the compressor output port to the second refrigerant port; a second bypass refrigerant line connecting the first refrigerant port to the first outdoor port; a first controllable valve located on the first bypass refrigerant line, the first controllable valve being configured to have a first open state that passes the refrigerant and a first closed state that prohibits passage of the refrigerant; and a second controllable valve located on the second bypass refrigerant line between the first refrigerant port and the first outdoor port, the second controllable valve being configured to have a second open state that passes the refrigerant and a second closed state that prohibits passage of the refrigerant.

The refrigeration cycle device may further comprise a water heater connected to the water heat exchanger, the water heater including a water storage tank that contains the water.

The water heat exchanger may be one of a heat exchange loop wrapped outside the water storage tank or a heat exchange loop located inside the water storage tank.

The refrigeration cycle device may further comprise a control circuit configured to control operation of at least the compressor, the four-way valve, the first controllable valve, and the second controllable valve.

The control circuit may include at least one of a microcomputer, a microprocessor, or an application-specific integrated circuit.

The first and second controllable valves may be solenoid valves.

In one embodiment a refrigeration cycle device is provided, comprising: a compressor configured to receive a refrigerant at a compressor input port, compress the refrigerant, and pass the compressed refrigerant from a compressor output port; an outdoor air heat exchanger having a first outdoor port and a second outdoor port, configured to exchange heat between the refrigerant passing between the first and second outdoor ports and outside air located outside a target space; an indoor air heat exchanger having a first indoor port and a second indoor port, configured to exchange heat between the refrigerant passing between the first and second indoor ports and inside air located inside the target space; a water heat exchanger having a first refrigerant port and a second refrigerant port, configured to exchange heat between the refrigerant passing between the first and second refrigerant ports and water; a four-way valve located between the first indoor port, the first outdoor port, the compressor input port, and the compressor output port, the four-way valve being configured to selectively either connect the first indoor port to the compressor input port and the first outdoor port to the compressor output port, or to connect the first outdoor port to the compressor input port and the first indoor port to the compressor output port; a first refrigerant line connecting the compressor output port to the four-way valve; a second refrigerant line connecting the compressor input port to the four-way valve; a third refrigerant line connecting the first outdoor port to the four-way valve; a fourth refrigerant line connecting the first indoor port to the four-way valve; a fifth refrigerant line connecting the second indoor port to the second outdoor port; a sixth refrigerant line connecting the compressor output port to the second refrigerant port; a seventh refrigerant line connecting the first refrigerant port to the first outdoor port; a first linear expansion valve located on the fifth refrigerant line between the second indoor port and a first intermediate node; a second linear expansion valve located on the fifth refrigerant line between the first intermediate node and the second outdoor port; a third linear expansion valve located between a second intermediate node on the seventh refrigerant line and the first intermediate node on the fifth refrigerant line; a first controllable valve located on the sixth refrigerant line, the first controllable valve being configured to have a first open state that passes the refrigerant and a first closed state that prohibits passage of the refrigerant; and a second controllable valve located on the seventh refrigerant line between the second intermediate node and the first outdoor port, the second controllable valve being configured to have a second open state that passes the refrigerant and a second closed state that prohibits passage of the refrigerant; and a third controllable valve located on the first refrigerant line, the third controllable valve being configured to have a third open state that passes the refrigerant and a third closed state that prohibits passage of the refrigerant.

The refrigeration cycle device may further comprise a water heater connected to the water heat exchanger, the water heater including a water storage tank that contains the water.

The water heat exchanger may be one of a heat exchange loop wrapped outside the water storage tank or a heat exchange loop located inside the water storage tank.

The refrigeration cycle device may further comprise a control circuit configured to control operation of at least the compressor, the four-way valve, the first controllable valve, and the second controllable valve.

The control circuit may include at least one of a microcomputer, a microprocessor, or an application-specific integrated circuit.

The refrigeration cycle device may further comprise an accumulator located on the second refrigerant line between the compressor input port and the four-way valve.

The first, second, and third controllable valves may be solenoid valves.

In one embodiment a method of operating a refrigeration cycle device is provided, comprising: receiving refrigerant in a first state at a compressor; compressing the refrigerant in the first state to covert the refrigerant in the first state to refrigerant in a second state; providing the refrigerant in the second state from the compressor to a water heat exchanger; desuperheating the refrigerant in the second state in the water heat exchanger such that heat is exchanged between the refrigerant in the second state and water to heat the water and convert the refrigerant in the second state to refrigerant in a third state; partially condensing the refrigerant in the third state in the water heat exchanger such that heat is exchanged between the refrigerant in the second state and water to heat the water and convert the refrigerant in the third state to refrigerant in a fourth state; providing the refrigerant in the fourth state from the water heat exchanger to an outdoor air heat exchanger; fully condensing the refrigerant in the fourth state in the outdoor air heat exchanger such that heat is exchanged between the refrigerant in the fourth state and outside air located outside a target space to heat the outside air and convert the refrigerant in the fourth state to refrigerant in a fifth state; expanding the refrigerant in the fifth state from the outdoor air heat exchanger to convert the refrigerant in the fifth state to refrigerant in a sixth state; providing the refrigerant in the sixth state to an indoor air heat exchanger; evaporating the refrigerant in the sixth state in the indoor air heat exchanger such that heat is exchanged between the refrigerant in the sixth state and inside air located inside the target space to cool the inside air and convert the refrigerant in the sixth state to the refrigerant in the first state, wherein the first state, the second state, the third state, the fourth state, the fifth state, and the sixth state are all different states of the refrigerant.

The method may further comprise repeatedly performing the operations of receiving the refrigerant in the first state, performing the compression operation on the refrigerant in the first state, providing the refrigerant in the second state from the compressor to the water heat exchanger, desuperheating the refrigerant in the second state in the water heat exchanger, partially condensing the refrigerant in the third state in the water heat exchanger, providing the refrigerant in the fourth state from the water heat exchanger to an outdoor air heat exchanger, fully condensing the refrigerant in the fourth state in the outdoor air heat exchanger, expanding the refrigerant in the fifth state, providing the refrigerant in the sixth state to an indoor air heat exchanger, and evaporating the refrigerant in the sixth state in the indoor air heat exchanger.

In one embodiment the refrigerant in the first state may be at a temperature between 13° C. and 18° C. and at a pressure between 130 psig and 143, the refrigerant in the second state may be at a temperature between 68° C. and 71° C. and at a pressure between 528 psig and 555 psig, the refrigerant in the third state may be at a temperature between 59° C. and 61° C. and at a pressure between 528 psig and 555 psig, the refrigerant in the fourth state may be at a temperature between 59° C. and 61° C. and at a pressure between 528 psig and 555 psig, the refrigerant in the fifth state may be at a temperature between 54° C. and 56° C. and at a pressure between 528 psig and 555, and the refrigerant in the sixth state may be at a temperature between 7° C. and 10° C. and at a pressure between 130 psig and 143 psig.

In another embodiment the refrigerant in the first state may be at a temperature between 13° C. and 18° C. and at a pressure between 130 psig and 143 psig, the refrigerant in the second state may be at a temperature between 66° C. and 69° C. and at a pressure between 340 psig and 365 psig, the refrigerant in the third state may be at a temperature between 40° C. and 43° C. and at a pressure between 340 psig and 365 psig, the refrigerant in the fourth state may be at a temperature between 40° C. and 43° C. and at a pressure between 340 psig and 365 psig, the refrigerant in the fifth state may be at a temperature between 37° C. and 40° C. and at a pressure between 340 psig and 365 psig, and the refrigerant in the sixth state may be at a temperature between 7° C. and 10° C. and at a pressure between 130 psig and 143 psig.

The operation of first condensing the refrigerant in the water heat exchanger may be performed by one of passing the refrigerant through an external refrigerant coil surrounding a water storage tank or passing the refrigerant through an internal refrigerant could formed inside the water storage tank.

The method may further comprise pumping the refrigerant in the second state from the compressor to a water heat exchanger.

The second state may be a superheated state.

BRIEF DESCRIPTION OF THE DRAWINGS

The accompanying figures, where like reference numerals refer to identical or functionally similar elements and which together with the detailed description below are incorporated in and form part of the specification, serve to further illustrate an exemplary embodiment and to explain various principles and advantages in accordance with the present disclosure.

DETAILED DESCRIPTION

Refrigeration Cycle Device

Figure 1:
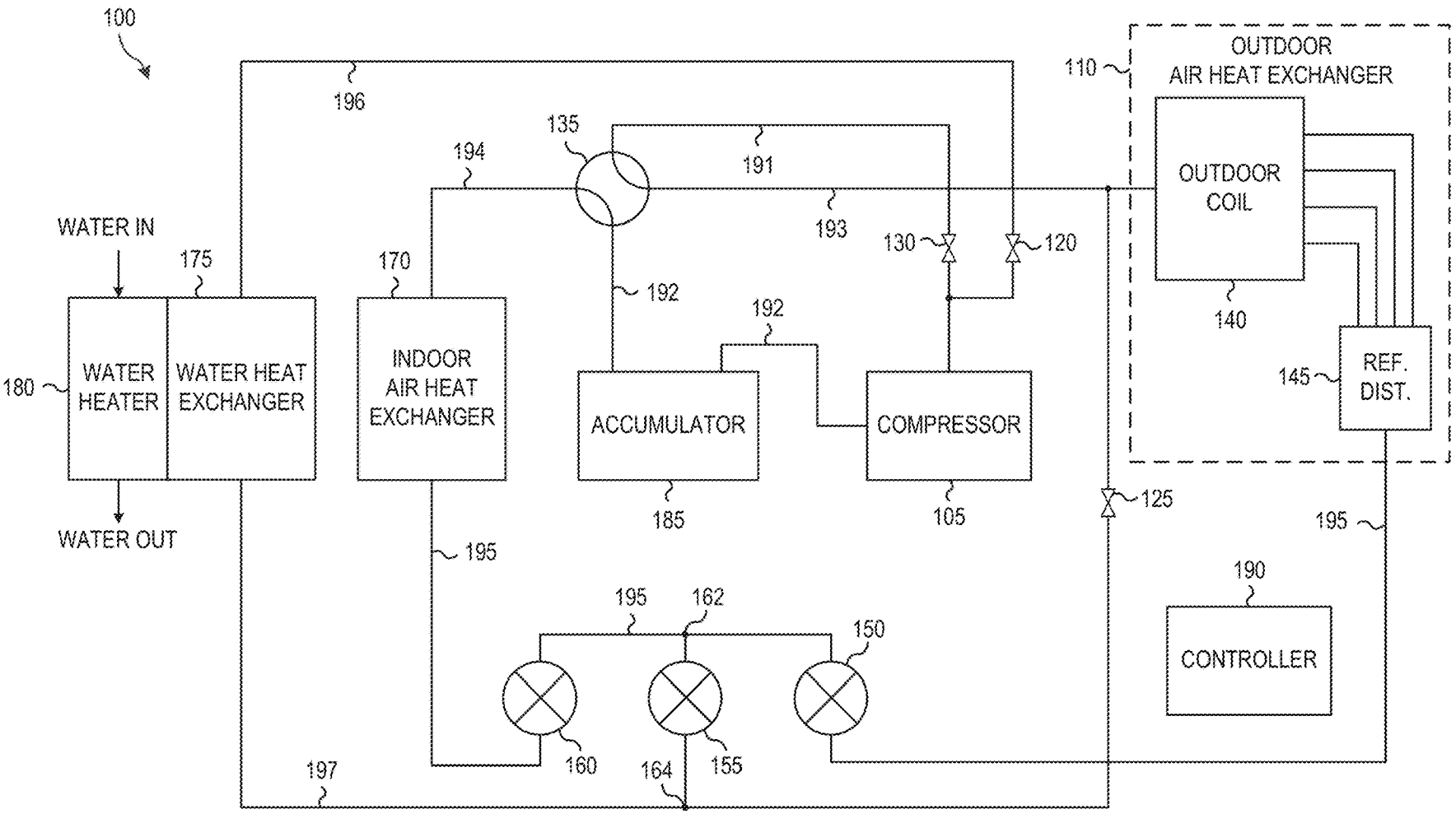
FIG. 1 is a diagram of a refrigeration cycle device according to disclosed embodiments.

FIG. 1 is a diagram of a refrigeration cycle device 100 according to disclosed embodiments. As shown in FIG. 1, the refrigeration cycle device 100 includes a compressor 105, an outdoor air heat exchanger (outdoor HEX) 110, a first controllable valve 120, a second controllable valve 125, a third controllable valve 130, a four-way valve 135, a first expansion valve 150, a second expansion valve 155, a third expansion valve 160, a first intermediate node 162, a second intermediate node 164, an indoor air heat exchanger (indoor HEX) 170, a water heat exchanger (water HEX) 175, a water heater 180, an accumulator 185, a controller 190, a first refrigerant line 191, a second refrigerant line 192, a third refrigerant line 193, a fourth refrigerant line 194, a fifth refrigerant line 195, a sixth refrigerant line 196, and a seventh refrigerant line 197. The outdoor air heat exchanger 110 further includes an outdoor coil 140 and a refrigerant distributor 145.

The compressor 105 operates to receive refrigerant at a low pressure from the accumulator 185 at a compressor input port, compress the refrigerant to a higher pressure, and provide the higher-pressure refrigerant to one or both of the four-way valve 135 and the water heat exchanger 175 from a compressor output port.

Furthermore, since the compressor 105 operates to receive lower-pressure refrigerant and output higher-pressure refrigerant, it also operates to circulate the refrigerant through the refrigeration cycle device 100. In the disclosed embodiments, the operation of the compressor 105 is sufficient to keep the refrigerant circulating sufficiently for normal operation. In such embodiments there is no need for a separate pump to pump the refrigerant to any element in the refrigeration cycle device 100.

The outdoor air heat exchanger 110 operates to exchange heat between the refrigerant and outdoor air located outside of an indoor space (not shown) to be conditioned. During various indoor-space cooling modes, the outdoor air heat exchanger 110 can receive the refrigerant from compressor 105 or the water heat exchanger 175 and provide the refrigerant to the indoor air heat exchanger 170. During various indoor-space heating modes, the outdoor air heat exchanger 110 can receive the refrigerant from the indoor air heat exchanger 170 and/or the water heat exchanger 175 and provide the refrigerant to the compressor 105. During an active water heating mode, the outdoor air heat exchanger 110 can receive the refrigerant from the water heat exchanger 175 and provide the refrigerant to the compressor 105.

For ease of disclosure, a port on the outdoor air heat exchanger 110 connected to the four-way valve 135 via the third refrigerant pipe 193 and connected to the water heat exchanger 175 via the seventh refrigerant pipe 197 will be referred to as a first outdoor port. Similarly, a port on the outdoor air heat exchanger 110 connected to the indoor air heat exchanger 170 via the fifth refrigerant pipe 195 will be referred to as a second outdoor port.

The outdoor coil 140 is a portion of the outdoor air heat exchanger 110 that passes the refrigerant and is exposed to outdoor air. As the refrigerant passes through the outdoor coil 140 it exchanges heat with the outdoor air, absorbing heat if the outdoor air is warmer than the refrigerant and dissipating heat to the outdoor air if the outdoor air is cooler than the refrigerant. In various embodiments the outdoor coil 140 may include a plurality of parallel coil portions. In the embodiment of FIG. 1, a refrigerant distributor 145 is provided between the outdoor coil 140 and the second outdoor port. The refrigerant distributor 145 directs the refrigerant to and from the plurality of coil portions in the outdoor coil 140. Alternate embodiments could have a manifold connected between the outdoor coil 140 and the first outdoor port to facilitate the transfer of refrigerant to and from the plurality of coil portions in the outdoor coil 140.

The indoor air heat exchanger 170 operates to exchange heat between the refrigerant and indoor air located inside of the indoor space to be conditioned. During various indoor-space cooling modes, the indoor air heat exchanger 170 can receive the refrigerant from the outdoor air heat exchanger 110 and provide the refrigerant to the compressor 105. During various indoor-space heating modes, the indoor air heat exchanger 170 can receive the refrigerant from the compressor 105 and provide the refrigerant to the outdoor air heat exchanger 110. During an active water heating mode, the indoor air heat exchanger 170 does not have refrigerant circulated through it.

For ease of disclosure, a port on the indoor air heat exchanger 170 connected to the four-way valve 135 via the fourth refrigerant pipe 194 will be referred to as a first indoor port. Similarly, a port on the indoor air heat exchanger 170 connected to the outdoor air heat exchanger 110 via the fifth refrigerant pipe 195 will be referred to as a second indoor port.

The water heat exchanger 175 operates to exchange heat between the refrigerant and water located in the water heater 180. During various water heating modes, the water heat exchanger 175 receives refrigerant from the compressor 105 and provides refrigerant to the outdoor air heat exchanger 110.

For ease of disclosure, a port on the water heat exchanger 175 connected to the outdoor air heat exchanger 110 via the seventh refrigerant pipe 197 will be referred to as a first refrigerant port. Similarly, a port on the water heat exchanger 175 connected to the compressor 105 via the sixth refrigerant pipe 196 will be referred to as a second refrigerant port.

In some embodiments the water heat exchanger 175 could have a heating coil (not shown) that is wrapped around the water heater 180. In such an embodiment, heated refrigerant would pass through the heating coil during a water heating operation and would exchange heat with the water heater 180, which would heat the water inside the water heater 180.

In other embodiments the water heat exchanger 175 could have a heating coil (not shown) that is formed inside the water heater 180 in direct contact with the water inside the water heater 180. In such an embodiment heated refrigerant would pass through the heating coil during a water heating operation and would exchange heat directly with the water inside the water heater 180.

The water heater 180 is configured to hold a quantity of water that can be heated by exchanging heat between the water and refrigerant flowing through the water heat exchanger 175. The water heater 180 has a water inlet port that draws water into the water heater 180 and a water outlet port that outputs water from the water heater 180. In some embodiments the water heater is a tank configured to hold a quantity of water.

The accumulator 185 is located on the second refrigerant pipe 192 between the four-way valve 135 and the compressor input port of the compressor 105. It operates as a refrigerant reservoir that regulates the amount of refrigerant provided to the compressor 105 to prevent damage to the compressor 105.

The four-way valve 135 operates to selectively connect the compressor output port of the compressor 105, the accumulator 185, the first outdoor port of the outdoor air heat exchanger 110, and the first indoor port of the indoor air heat exchanger 170. In a first configuration the four-way valve connects the compressor output port of the compressor 105 to the first outdoor port of the outdoor air heat exchanger 110 and the first indoor port of the indoor air heat exchanger 170 to the accumulator 185. In a second configuration the four-way valve connects the compressor output port of the compressor 105 to the first indoor port of the indoor air heat exchanger 170 and the first outdoor port of the outdoor air heat exchanger 110 to the accumulator 185.

The first refrigerant line 191 is a line or pipe configured to pass refrigerant between the compressor output port of the compressor 105 and the four-way valve 135.

The second refrigerant line 192 is a line or pipe configured to pass refrigerant between the four-way valve 135 and the accumulator 185.

The third refrigerant line 193 is a line or pipe configured to pass refrigerant between the four-way valve 135 and the first outdoor port of the outdoor air heat exchanger 110.

The fourth refrigerant line 194 is a line or pipe configured to pass refrigerant between the four-way valve 135 and the first indoor port of the indoor air heat exchanger 170.

The fifth refrigerant line 195 is a line or pipe configured to pass refrigerant between the second indoor port of the indoor air heat exchanger 170 and the second outdoor port of the outdoor air heat exchanger 110.

The sixth refrigerant line 196 is a line or pipe configured to pass refrigerant between the compressor output port of the compressor 105 and the second refrigerant port of the water heat exchanger 175. The sixth refrigerant line 196 can also be called a first bypass line since it bypasses the normal routing of refrigerant through the refrigeration cycle device 100, routing it instead through the water heat exchanger 175.

The seventh refrigerant line 197 is a line or pipe configured to pass refrigerant between the first refrigerant port of the water heat exchanger 175 and the first outdoor port of the outdoor air heat exchanger 110. The seventh refrigerant line 197 can also be called a second bypass line since it bypasses the normal routing of refrigerant through the refrigeration cycle device 100, routing it instead through the water heat exchanger 175.

The first expansion valve 150 is located on the fifth refrigerant line 195 between the second outdoor port on the outdoor air heat exchanger 110 and the first intermediate node 162. It operates to selectively remove pressure from the refrigerant passing between the outdoor air heat exchanger 110 and the indoor air heat exchanger 170 along the fifth refrigerant line 195. This drop in pressure will result in a drop in the temperature of the refrigerant. The first expansion valve 150 can be set to be: (a) controlling flow, reducing the pressure of the refrigerant that flows through it; (b) entirely open, allowing refrigerant to freely flow through it; or (c) fully closed, preventing any refrigerant from passing through it.

The second expansion valve 155 is located between the first intermediate node 162 on the fifth refrigerant line 195 and the second intermediate node 164 on the seventh refrigerant line 197. It operates to selectively remove pressure from the refrigerant passing between the water heat exchanger 175 and the outdoor air heat exchanger 110 along the fifth refrigerant line 195 and the seventh refrigerant line 197. This drop in pressure will result in a drop in the temperature of the refrigerant. The second expansion valve 155 can be set to be: (a) controlling flow, reducing the pressure of the refrigerant that flows through it; (b) entirely open, allowing refrigerant to freely flow through it; or (c) fully closed, preventing any refrigerant from passing through it.

The third expansion valve 160 is located on the fifth refrigerant line 195 between the first intermediate node 162 and the second indoor port on the indoor air heat exchanger 170. It operates to selectively remove pressure from the refrigerant passing between the outdoor air heat exchanger 110 and the indoor air heat exchanger 170 along the fifth refrigerant line 195. This drop in pressure will result in a drop in the temperature of the refrigerant. The third expansion valve 160 can be set to be: (a) controlling flow, reducing the pressure of the refrigerant that flows through it; (b)

entirely open, allowing refrigerant to freely flow through it; or (c) fully closed, preventing any refrigerant from passing through it.

The first intermediate node 162 is a point on the fifth refrigerant line 195 to which the first, second, and third expansion valves 150, 155, 160 are all connected.

The second intermediate node 164 is a point on the seventh refrigerant line 197 to which the first refrigerant port of the water heat exchanger 175, the second expansion valve 155, and the second controllable valve 125 are all connected.

The first controllable valve 120 is located on the sixth refrigerant line 196 and is configured to have a first open state that passes the refrigerant and a first closed state that prohibits passage of the refrigerant.

The second controllable valve 125 is located on the seventh refrigerant line 197 between the second intermediate node 164 and the first outdoor port of the outdoor air heat exchanger 110, and is configured to have a second open state that passes the refrigerant and a second closed state that prohibits passage of the refrigerant.

The third controllable valve 130 is located on the first refrigerant line 191 and is configured to have a third open state that passes the refrigerant and a third closed state that prohibits passage of the refrigerant.

In some embodiments the first, second, and third controllable valves 120, 125, 130 can be solenoid valves.

The controller 190 operates to control the various components in the refrigeration cycle device 100. For example, it can control the operation of the compressor 105, select the configuration of the four-way valve 135, set the expansion amount of the first, second, and third expansion valves 150, 155, 160, and open and close the first, second, and third controllable valves 120, 125, 130. Although not shown in FIG. 1, the controller 190 can be connected to the compressor 105, the four-way valve 135, the first, second, and third expansion valves 150, 155, 160, and the first, second, and third controllable valves 120, 125, 130 by control lines.

The refrigeration cycle device 100 can be operated in multiple different modes depending upon how the four-way valve 135, the first, second, and third expansion valves 150, 155, 160, and the first, second, and third controllable valves 120, 125, 130 are controlled. Five of these operational modes will be described below: (1) a cooling space only operation; (2) a heating space only operation; (3) a heat recovery operation; (4) an active water heating operation; and (5) an active water heating and space heating operation.

Cooling Space Only Operation

Figure 2:
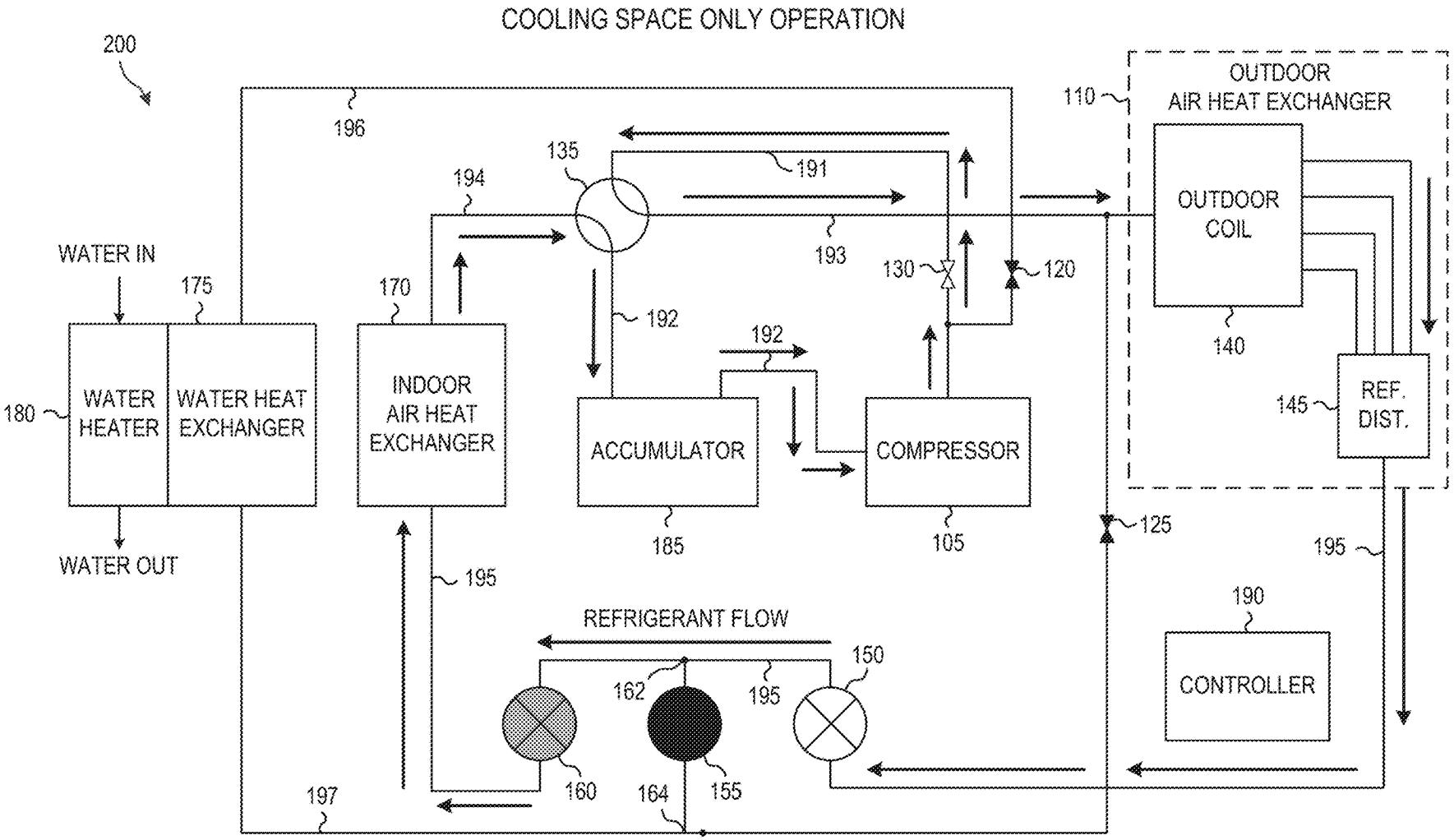
FIG. 2 is a diagram of the refrigeration cycle device of FIG. 1 in a cooling space only operation according to disclosed embodiments.

FIG. 2 is a diagram 200 of the refrigeration cycle device 100 of FIG. 1 in a cooling space only operation according to disclosed embodiments. During the cooling space only operation the indoor air heat exchanger 170 operates to cool the indoor space and the water heat exchanger 175 does not operate to heat the water in the water heater 180.

As shown in FIG. 2, during the cooling space only operation, the four-way valve 135, the first, second, and third controllable valves 120, 125, 130, and the first, second, and third expansion valves 150, 155, 160 are set as follows. The four-way valve 135 is set in the first configuration in which the compressor output port of the compressor 105 is connected to the first outdoor port of the outdoor air heat exchanger 110 and the first indoor port of the indoor air heat exchanger 170 is connected to the accumulator 185. The first and second controllable valves 120, 125 are set to be closed and the third controllable valve 130 is set to be opened. The first expansion valve 150 is set to be fully opened; the second expansion valve 155 is set to be fully closed; and the third expansion valve 160 is set to be controlling flow.

Figure 3:
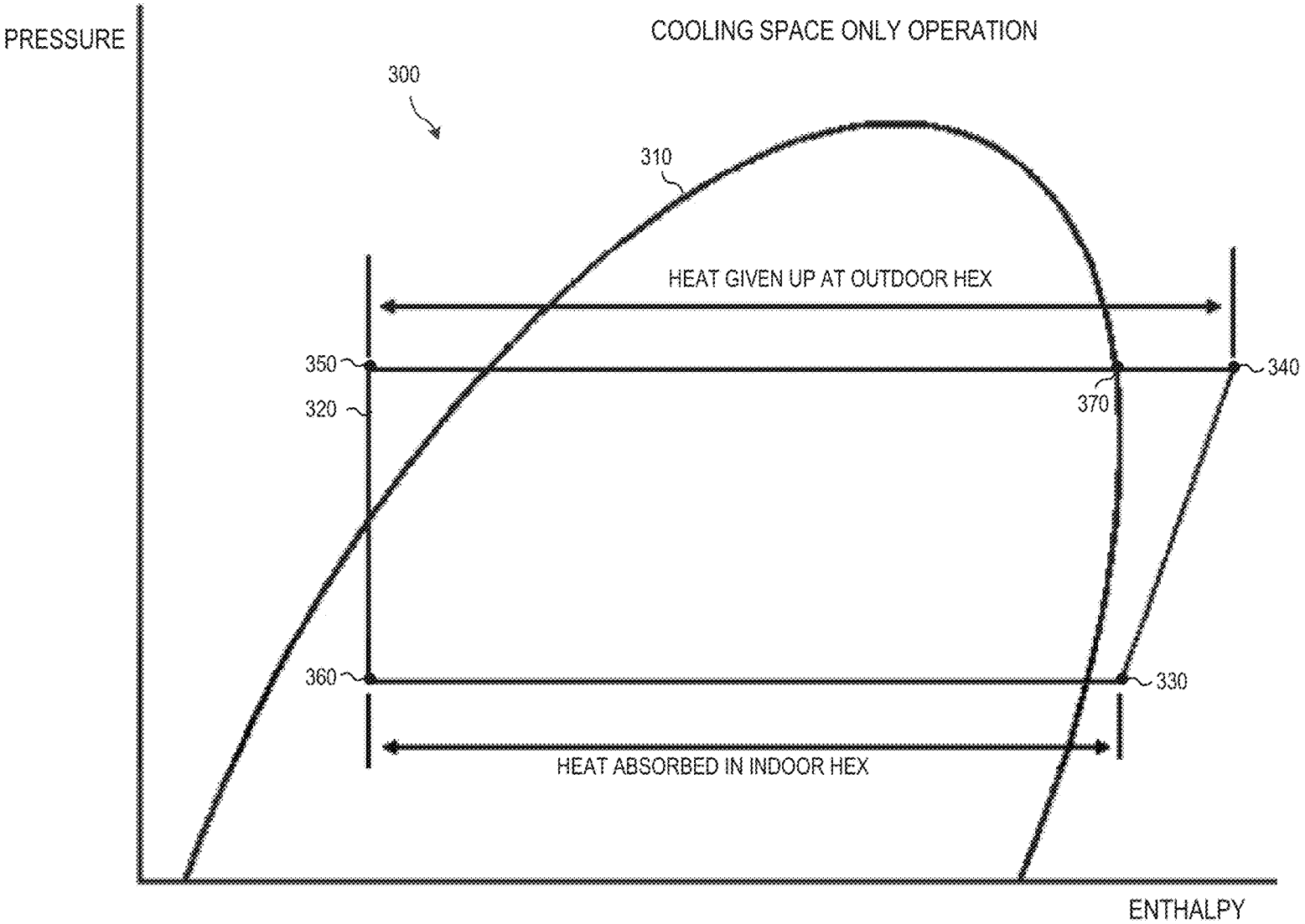
FIG. 3 is a graph of the refrigeration cycle of the refrigeration cycle device of FIG. 1 in the cooling space only operation of FIG. 2 according to disclosed embodiments.

FIG. 3 is a graph 300 of the refrigeration cycle of the refrigeration cycle device 100 of FIG. 1 in the cooling space only operation of FIG. 2 according to disclosed embodiments. As shown in FIG. 3, the graph 300 shows a pressure-enthalpy curve 310 and a first refrigeration cycle 320.

The pressure-enthalpy curve 310 indicates the various thermodynamic states of a refrigerant. The area within the enthalpy curve 310 represents the refrigerant in a saturated liquid and vapor state; the area under the enthalpy curve 310 represents the refrigerant in a liquid and gas mixture; the area above and to the left of the enthalpy curve 310 represents the refrigerant in a subcooled liquid state; and the area above and to the right of the enthalpy curve 310 represents the refrigerant in a superheated gas state. A critical point at the top of the enthalpy curve represents the highest temperature at which the refrigerant can be condensed.

The first refrigeration cycle 320 represents the state of the refrigerant as it passes through the refrigeration cycle device 100 during the cooling space only operation. The refrigerant passes through a cycle of compression, condensation, expansion, and evaporation, as it passes through the first refrigeration cycle 320. Compression takes place from a first state 330 to a second state 340; condensation takes place from the second state 340 to a third state 350; expansion takes place from the third state 350 to a fourth state 360; and evaporation takes place from the fourth state 350 to the first state 330. The first state 330 is at a relatively high enthalpy and a lowest pressure; the second state 340 is at a highest enthalpy and pressure; the third state 350 is at a highest pressure and lowest enthalpy; and the fourth state 360 is at the lowest pressure and enthalpy. A fifth state 370 represents a point on the pressure-enthalpy curve 310 at which the refrigerant is desuperheated as it passes from the second state 340 to the third state 350.

As shown in FIGS. 2 and 3, the refrigerant is compressed at the compressor 105 to move the refrigerant in the first state 330 to refrigerant in the second state 320, increasing the pressure and the temperature of the refrigerant. As shown in FIG. 3, the refrigerant can be superheated in the first state 330 and is superheater in the second state 340.

The compressor 105 outputs the compressed refrigerant at the compressor output port to the first refrigerant line 191. Since the third controllable valve 130 is open, the refrigerant passes through the first refrigerant line 191 to the four-way valve 135. Since the second controllable valve 125 is closed, refrigerant will not flow through the sixth refrigerant line 196 to the water heat exchanger 175.

Since the four-way valve 135 is in the first configuration, the refrigerant received from the first refrigerant line 191 will pass through the four-way valve 135 to the third refrigerant line 193. The refrigerant will then pass through the third refrigerant line 193 to the first outdoor port of the outdoor air heat exchanger 110.

The superheated refrigerant is then cooled at the outdoor air heat exchanger 110 through a condensation operation in the outdoor coil 140 in the outdoor air heat exchanger 110. In this condensation operation, the refrigerant in the outdoor coil 140 will give up heat to the outdoor air. This operation drops the enthalpy of the refrigerant while maintaining its pressure as the refrigerant moves from the second state 340 to the third state 350. As shown in FIG. 3, the refrigerant can be subcooled in the third state 350.

The cooled refrigerant then passes from the outdoor coil 140, through the refrigerant distributor 145 to the second outdoor port of the outdoor air heat exchanger 110 and then to the fifth refrigerant line 195. The cooled refrigerant then passes through the fifth refrigerant line 195, the first expansion valve 150, and the third expansion valve 160 to the second indoor port of the indoor air heat exchanger 170.

Since the first expansion valve 150 is fully open, the refrigerant will pass through the first expansion valve 150 unchanged. However, since the third expansion valve 160 is set to control flow, the refrigerant is expanded as it passes through the third expansion valve 160 to lower its pressure and move from the third state 350 to the fourth state 360.

The refrigerant then absorbs heat at the indoor air heat exchanger 170 through an evaporation operation at an indoor coil in the indoor air heat exchanger 170, thereby cooling the indoor air. In other words, in this operation, the refrigerant exchanges heat with the indoor air. This evaporation operation raises the enthalpy of the refrigerant while maintaining its pressure as the refrigerant moves from the fourth state 360 back to the first state 330.

The evaporated refrigerant is then provided to the first indoor port of the indoor air heat exchanger 170, to the fourth refrigerant line 194, and through the fourth refrigerant line 194 to the four-way valve 135.

Since the four-way valve 135 is in the first configuration, the refrigerant will pass from the fourth refrigerant line 194, through the four-way valve 135, and to the second refrigerant line 192. The refrigerant will then pass through the second refrigerant line 192, by way of the accumulator 185, to the compressor 105. In the compressor 105, the refrigerant will again be compressed to change it from the first state 330 to the second state 340, and the cycle will continue.

As shown in FIGS. 2 and 3, the refrigeration cycle device 100 will then continue to operate according to the first refrigeration cycle 320. During this first refrigeration cycle 320, the refrigerant will give up heat at the outdoor air heat exchanger 110 and absorb heat at the indoor air heat exchanger 170, thereby performing a cooling space only operation that cools the indoor space.

The enthalpy curve 310 and first refrigeration cycle 320 are provided for one exemplary refrigerant and the disclosed refrigeration cycle device 100 shown in FIG. 1. They are meant to show the general operation of a first refrigerant cycle 320. Although the specific parameters of the enthalpy curve 310 and first refrigeration cycle 320 would be different for a different refrigerant or a refrigeration cycle device arranged differently than the refrigeration cycle device 100 of FIG. 1, the general operation would remain the same.

Heating Space Only Operation

Figure 4:
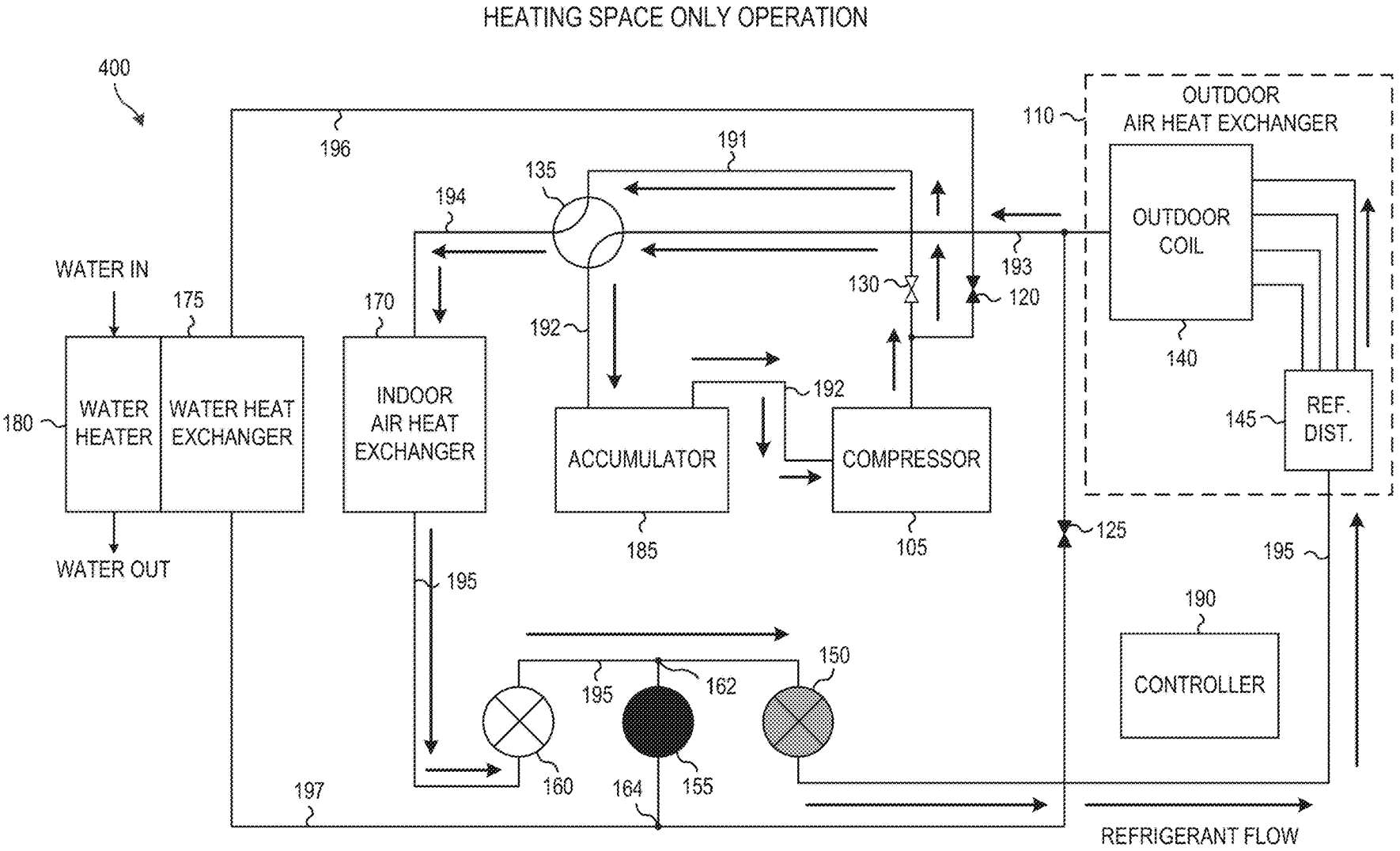
FIG. 4 is a diagram of the refrigeration cycle device of FIG. 1 in a heating space only operation according to disclosed embodiments.

FIG. 4 is a diagram 400 of the refrigeration cycle device 100 of FIG. 1 in a heating space only operation according to disclosed embodiments. During the heating space only operation the indoor air heat exchanger 170 operates to heat the indoor space and the water heat exchanger 175 does not operate to heat the water in the water heater 180.

As shown in FIG. 4, during the heating space only operation, the four-way valve 135, the first, second, and third controllable valves 120, 125, 130, and the first, second, and third expansion valves 150, 155, 160 are set as follows. The four-way valve 135 is set in the second configuration in which the compressor output port of the compressor 105 is connected to the first outdoor port of the indoor air heat exchanger 170 and the first outdoor port of the outdoor air heat exchanger 110 is connected to the accumulator 185. The first and second controllable valves 120, 125 are set to be closed and the third controllable valve 130 is set to be opened. The first expansion valve is set to be controlling flow; the second expansion valve is set to be fully closed; and the third expansion valve is set to be fully opened.

Figure 5:
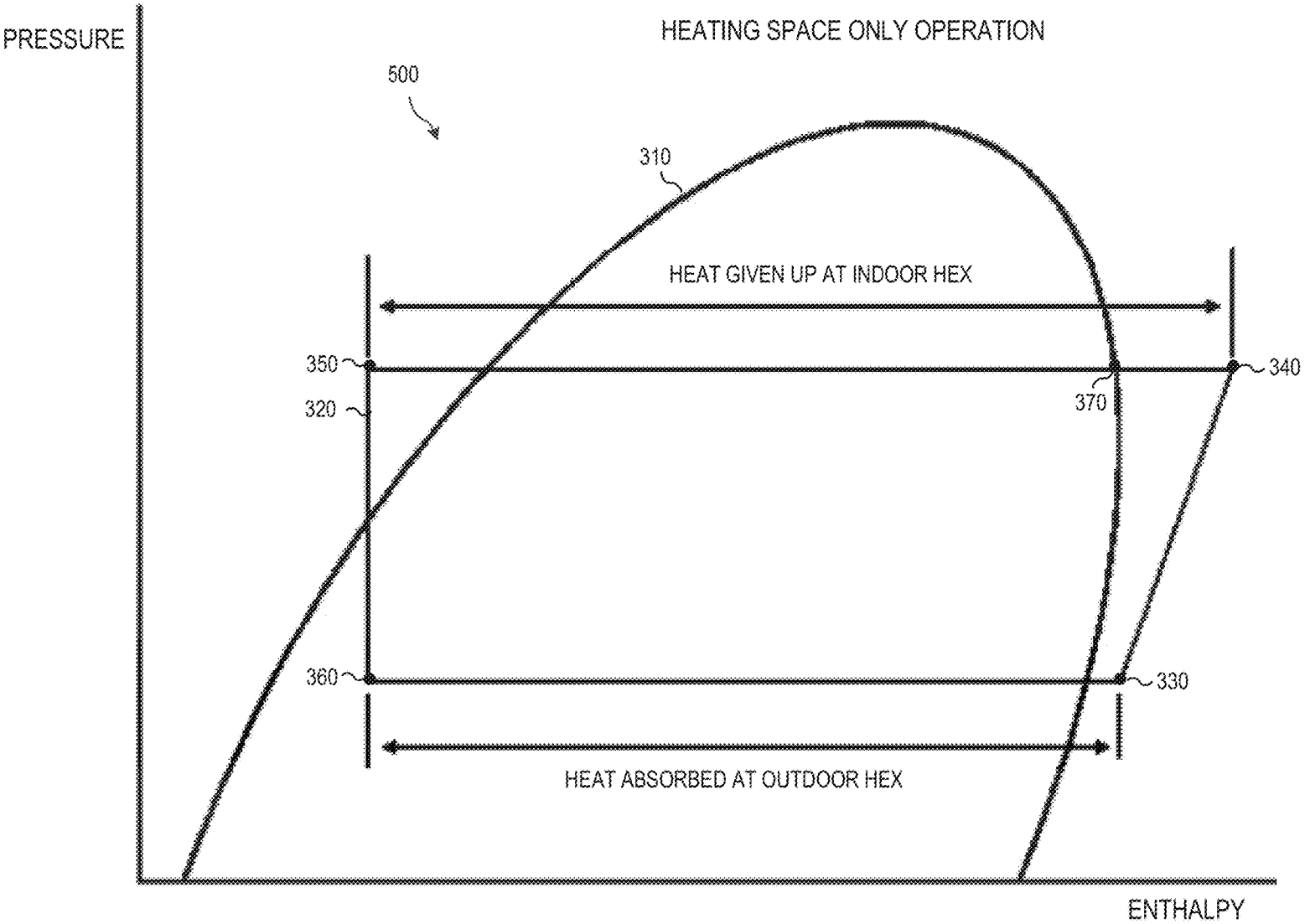
FIG. 5 is a graph of the refrigeration cycle of the refrigeration cycle device of FIG. 1 in the heating space only operation of FIG. 4 according to disclosed embodiments.

FIG. 5 is a graph 500 of the refrigeration cycle of the refrigeration cycle device 100 of FIG. 1 in the heating space only operation of FIG. 4 according to disclosed embodiments. As shown in FIG. 5, the graph 500 shows a pressure-enthalpy curve 310 and a first refrigeration cycle 320.

The pressure-enthalpy curve 310 is just as is shown in FIG. 3. For purposes of simplifying the disclosure, its description will not be repeated here.

The first refrigeration cycle 320 represents the state of the refrigerant as it passes through the refrigeration cycle device 100 during the heating space only operation. As in the cooling space only operation, the refrigerant passes through a cycle of compression, condensation, expansion, and evaporation, as it passes through the first refrigeration cycle 320. Compression takes place from a first state 330 to a second state 340; condensation takes place from the second state 340 to a third state 350; expansion takes place from the third state 350 to a fourth state 360; and evaporation takes place from the fourth state 350 to the first state 330. The first state 330 is at a relatively high enthalpy and a lowest pressure; the second state 340 is at a highest enthalpy and pressure; the third state 350 is at a highest pressure and lowest enthalpy; and the fourth state 360 is at the lowest pressure and enthalpy.

As shown in FIGS. 4 and 5, the refrigerant is compressed at the compressor 105 to move the refrigerant in the first state 330 to refrigerant in the second state 340, increasing the pressure and the temperature of the refrigerant. As shown in FIG. 3, the refrigerant can be superheated at the first state 330 and is superheated at the second state 340.

The compressor 105 outputs the compressed refrigerant at the compressor output port to the first refrigerant line 191. Since the third controllable valve 130 is open, the refrigerant passes through the first refrigerant line 191 to the four-way valve 135. Since the first controllable valve 120 is closed, refrigerant will not flow through the sixth refrigerant line 196 to the water heat exchanger 175.

Since the four-way valve 135 is in the second configuration, the refrigerant received from the first refrigerant line 191 will pass through the four-way valve 135 to the fourth refrigerant line 194. The refrigerant will then pass through the fourth refrigerant line 194 to the first indoor port of the indoor air heat exchanger 170.

The superheated refrigerant is then cooled at the indoor air heat exchanger 110 through a condensation operation in an indoor coil in the indoor air heat exchanger 170. In this condensation operation, the refrigerant in the outdoor coil 140 will give up heat to the indoor air, thereby heating the indoor space. This operation drops the enthalpy of the refrigerant while maintaining its pressure as the refrigerant moves from the second state 340 to the third state 350. As shown in FIG. 5, the refrigerant can be subcooled in the third state 350.

The cooled refrigerant is then passed through the second indoor port of the indoor air heat exchanger 170 to the fifth refrigerant line 195. The cooled refrigerant will then pass through the fifth refrigerant line 195, the third expansion valve 160, and the first expansion valve 150 to the second outdoor port of the outdoor air heat exchanger 110. From there it passes through the refrigerant distributor 145 to the outdoor coil 140.

Since the third expansion valve 160 is fully open, the refrigerant will pass through the third expansion valve 160 unchanged. However, since the first expansion valve 150 is set to control flow, the refrigerant is expanded as it passes through the first expansion valve 150 to lower its pressure and move from the third state 350 to the fourth state 360.

The refrigerant then absorbs heat at the outdoor air heat exchanger 170 through an evaporation operation at the outdoor coil 140 in the outdoor air heat exchanger 110. In other words, in this operation, the refrigerant exchanges heat with the outdoor air. This evaporation operation raises the enthalpy of the refrigerant while maintaining its pressure as the refrigerant moves from the fourth state 360 back to the first state 330.

The evaporated refrigerant is then provided to the first outdoor port of the outdoor air heat exchanger 110, to the third refrigerant line 193, and through the third refrigerant line 193 to the four-way valve 135.

Since the four-way valve 135 is in the second configuration, the refrigerant will pass from the third refrigerant line 193, through the four-way valve 135, and to the second refrigerant line 192. The refrigerant will then pass through the second refrigerant line 192, by way of the accumulator 185, to the compressor 105. In the compressor 105, the refrigerant will again be compressed to change it from the first state 330 to the second state 340, and the cycle will continue.

As shown in FIGS. 4 and 5, the refrigeration cycle device 100 will continue to operate according to the first refrigeration cycle 320. During this first refrigeration cycle 320, the refrigerant will absorb heat at the outdoor air heat exchanger 110 and dissipate heat at the indoor air heat exchanger 170, thereby performing a heating space only operation that heats the indoor space.

Heat Recovery Operation

Figure 6:
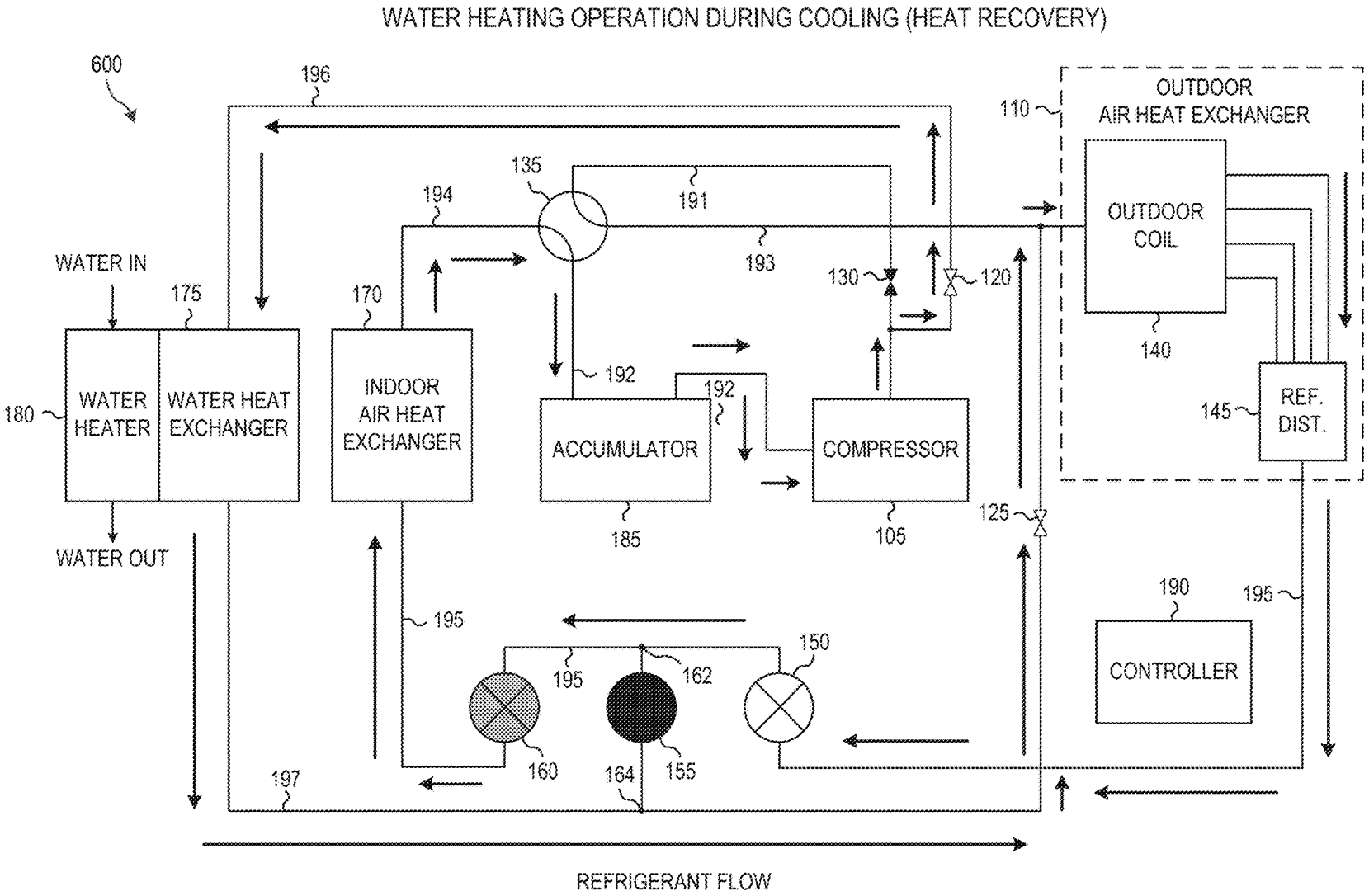
FIG. 6 is a diagram of the refrigeration cycle device of FIG. 1 in a heat recovery operation according to disclosed embodiments.

FIG. 6 is a diagram 600 of the refrigeration cycle device 100 of FIG. 1 in a heat recovery operation according to disclosed embodiments. During the heat recovery operation, the indoor air heat exchanger 170 operates to cool the indoor space and the water heat exchanger 175 operates to heat the water in the water heater 180. This can be done using active water heating or passive water heating.

As shown in FIG. 6, during the heat recovery operation, the four-way valve 135, the first, second, and third controllable valves 120, 125, 130, and the first, second, and third expansion valves 150, 155, 160 are set as follows. The four-way valve 135 is set in the first configuration in which the compressor output port of the compressor 105 is connected to the first outdoor port of the outdoor air heat exchanger 110 and the first indoor port of the indoor air heat exchanger 170 is connected to the accumulator 185. The first and second controllable valves 120, 125 are set to be open and the third controllable valve 130 is set to be closed. The first expansion valve 150 is set to be fully opened; the second expansion valve 155 is set to be fully closed; and the third expansion valve 160 is set to be controlling flow.

Figure 7:
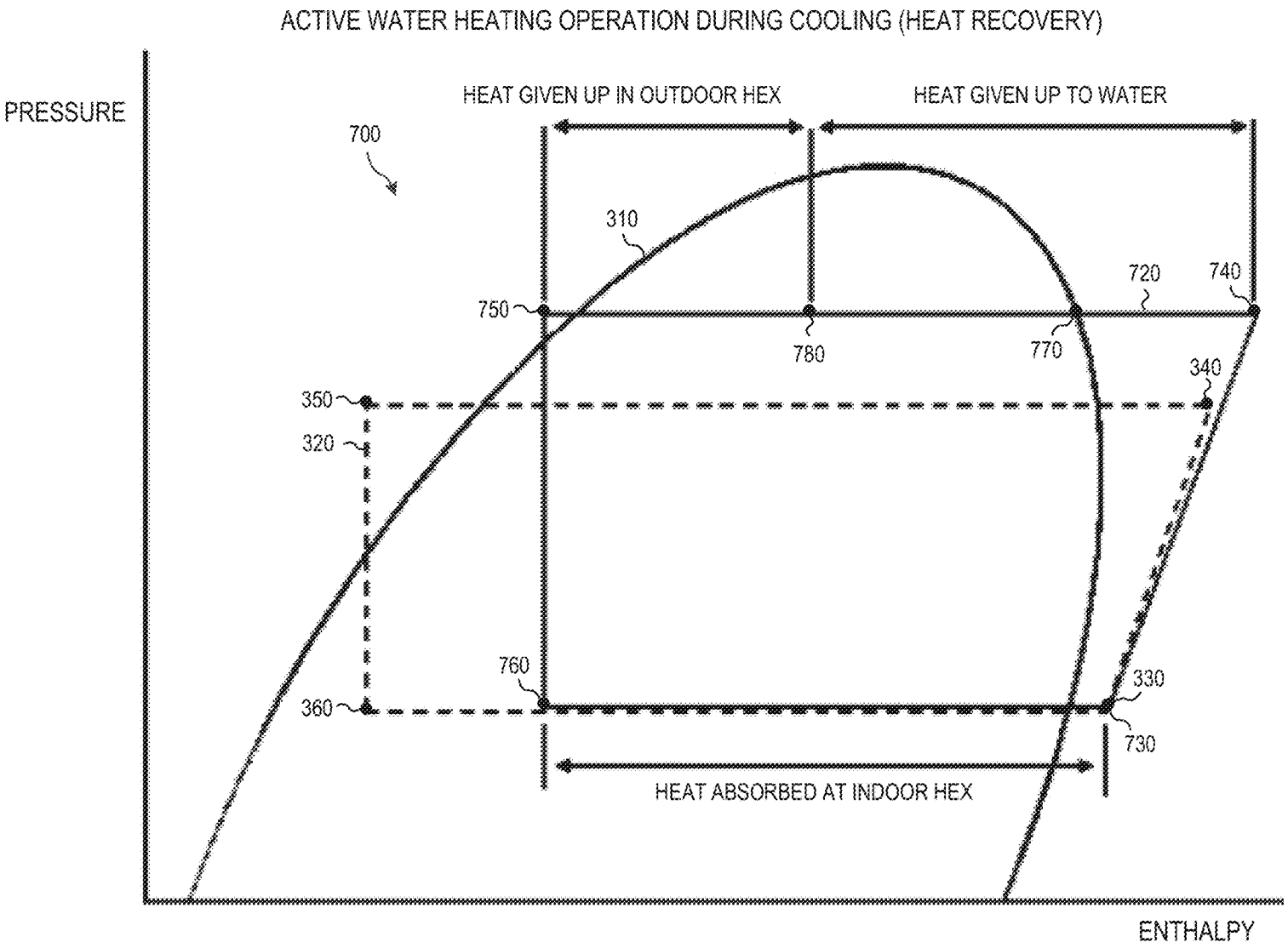
FIG. 7 is a graph of the refrigeration cycle of the refrigeration cycle device of FIG. 1 in the heat recovery operation of FIG. 6 using active water heating according to disclosed embodiments.
Figure 8:
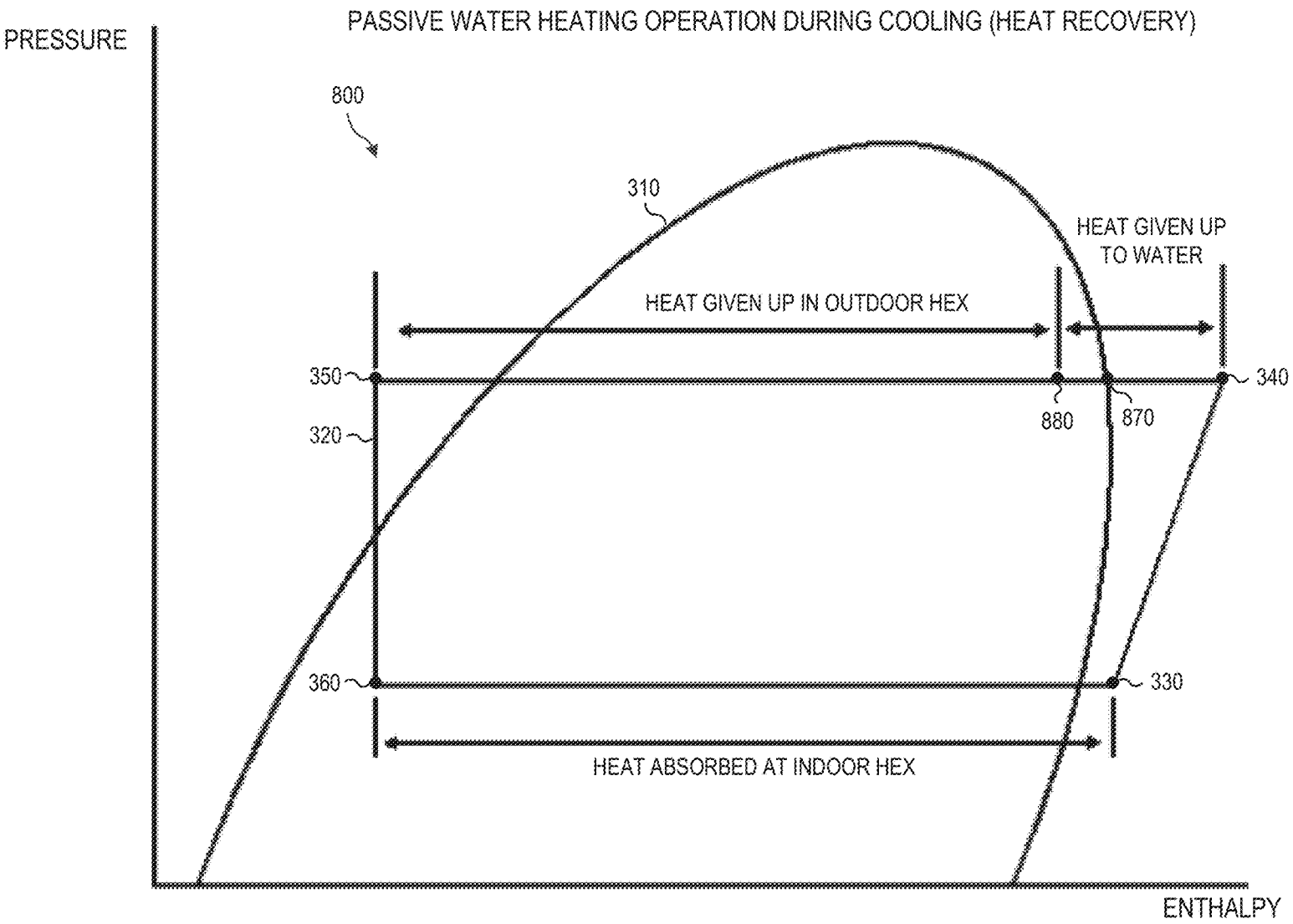
FIG. 8 is a graph of the refrigeration cycle of the refrigeration cycle device of FIG. 1 in the heat recovery operation of FIG. 6 using passive water heating according to disclosed embodiments.

FIG. 7 is a graph 700 of the refrigeration cycle of the refrigeration cycle device 100 of FIG. 1 in the heat recovery operation of FIG. 6 using active water heating according to disclosed embodiments. As shown in FIG. 7, the graph 700 shows a pressure-enthalpy curve 310, a first refrigeration cycle 320, and a second refrigeration cycle 720. FIG. 8 is a graph 800 of the refrigeration cycle of the refrigeration cycle device 100 of FIG. 1 in the heat recovery operation of FIG. 6 using passive water heating according to disclosed embodiments. As shown in FIG. 8, the graph 800 shows a pressure-enthalpy curve 310 and a first refrigeration cycle 320.

The pressure-enthalpy curve 310 is just as is shown in FIG. 3. For purposes of simplifying the disclosure, its description will not be repeated here.

The first refrigeration cycle 320 represents the state of the refrigerant as it passes through the refrigeration cycle device 100 during the heat recovery operation using passive water heating. The refrigerant passes through a cycle of compression, condensation, expansion, and evaporation, as it passes through the first refrigeration cycle 320. Compression takes place from a first state 330 to a second state 340; condensation takes place from the second state 340 to a third state 350; expansion takes place from the third state 350 to a fourth state 360; and evaporation takes place from the fourth state 350 to the first state 330. The first state 330 is at a relatively high enthalpy and a lowest pressure; the second state 340 is at a highest enthalpy and pressure; the third state 350 is at a highest pressure and lowest enthalpy; and the fourth state 360 is at the lowest pressure and enthalpy.

The second refrigeration cycle 720 represents the state of the refrigerant as it passes through the refrigeration cycle device 100 during the heat recovery operation using active water heating. The refrigerant passes through a cycle of compression, condensation, expansion, and evaporation, as it passes through the second refrigeration cycle 720. Compression takes place from a sixth state 730 to a seventh state 740; condensation takes place from the seventh state 740 to a eighth state 750; expansion takes place from the eighth state 750 to an ninth state 760; and evaporation takes place from the eighth state 750 to the sixth state 730. The sixth state 730 is at a relatively high enthalpy and a lowest pressure; the seventh state 740 is at a highest enthalpy and pressure; the eighth state 750 is at a highest pressure and lowest enthalpy; and the ninth state 760 is at the lowest pressure and enthalpy.

In the embodiment disclosed in FIGS. 6 and 7, the sixth state 730 is at a similar pressure and enthalpy as the first state 330; the seventh state 740 is at a higher pressure and enthalpy as the second state 340; the eighth state 750 is at a higher pressure and a higher enthalpy as the third state; and the ninth state 760 is at a similar pressure and a higher enthalpy as the fourth state 360.

The second refrigeration cycle 720 in FIG. 7 is provided for one exemplary refrigerant and the disclosed refrigeration cycle device 100 shown in FIG. 1. It is meant to show the general operation of the second refrigerant cycle 720. Although the specific parameters of the enthalpy curve 310 and the second refrigeration cycle 720 would be different for a different refrigerant or a refrigeration cycle device arranged differently than the refrigeration cycle device 100 of FIG. 1, the general operation would remain the same.

In the heat recovery operation using active water heating (FIGS. 6 and 7), the refrigerant is heated to a higher temperature and raised to a higher pressure when it is output from the compressor 105, i.e., when it is at the seventh state 740. In this way the refrigeration cycle device provides extra heat so that it can both cool the indoor space and heat the water in the water heater 180. This requires extra power to achieve but provides extra enthalpy to heat the water in the water heater 180 more quickly and effectively.

In the heat recovery operation using passive water heating (FIGS. 6 and 8), the refrigerant output from the compressor 105 is kept at the same heat and pressure that it would be for a regular cooling operation (e.g., the cooling space only operation). In other words, it is kept at the second state 340. As a result, there is a smaller amount of heat to provide the water heat exchanger 175 to heat the water in the water heater 180 as compared with in the heat recovery operation using active water heating. However, the heat provided to the water heat exchanger 175 to heat the water in the water heater 180 in this operation mode is heat that would otherwise be exchanged with outdoor air at the outdoor air heat exchanger 110. As a result, the energy used to heat the water in the water heater 180 is essentially free since it would have been dissipated into the outdoor air if it wasn't used to heat the water in the water heater 180. In other words, during the heat recovery operation using passive water heating the refrigerant cycle device can heat water in the water heater 180 without expending any more energy than it would have in the cooling space only operation.

In fact, both the heat recovery operation using passive water heating can operate more efficiently than a cooling space operation. During a heat recovery operation using passive water heating, the overall condensing surface for the condensing operation is increased since condensing takes place in both the water heat exchanger 175 and the outdoor air heat exchanger 110. As a result, the condensing efficiency of the heat recovery operation using passive water heating is higher than if the condensing operation was performed only in the outdoor air heat exchanger. As a result, not only does the heat recovery operation using passive water heating allow the water in the water heater 180 to be heated using essentially free heat, it also does so using less energy than if the indoor space were being cooled without heating the water in the water heater 180.

This same increased condensing efficiency occurs in the heat recovery operation using active water heating, meaning that the condensing operation in this operation mode is more efficient than a condensing operation in the cooling space only operation. This can reduce the extra energy required to heat the water in the water heater 180, though given that extra heat is provided to the refrigerant in this operation mode, it may still use more overall power than in a cooling space only operation.

In one disclosed embodiment, the refrigerant could be heated to 140° F. during a heat recovery operation using active water heating and heated to 105° F. during a heat recovery operation using passive water heating. This means that the total amount of heat provided to the water in the water heater 180 during a heat recovery operation using passive water heating would be less than the total amount of heat provided to the water in the water heater 180 during the heat recovery operation using active water heating.

However, because it heats the water in the water heater 180 using only waste heat, the heat recovery operation using passive water heating could be maintained indefinitely without increasing power consumption at all when the indoor air heat exchanger 170 was being used to cool the indoor space. In contrast, because of the extra power requirements for a heat recovery operation using active water heating, it would generally be undesirable to maintain such an operation for an extended period of time.

As shown in FIGS. 6 and 7, during the heat recovery operation using active water heating, the refrigerant is compressed at the compressor 105 to move the refrigerant in the sixth state 730 to refrigerant in the sixth state 720, increasing the pressure and the temperature of the refrigerant. As shown in FIG. 7, the refrigerant can be superheated at the sixth state 730 and is superheated at the seventh state 740. As noted above, the refrigerant in the sixth state 720 has a higher enthalpy and pressure than the refrigerant in the second state 340. In other words, the refrigerant is provided with more heat and pressure by the compressor 105 in the heat recovery operation using active water heating than it is in a cooling space only operation or a heat recovery operation using passive water heating.

The compressor 105 outputs the compressed refrigerant at the compressor output port to the sixth refrigerant line 196. Since the third controllable valve 130 is closed, the refrigerant will not flow through the first refrigerant line 191 to the four-way valve 135. Since the second controllable valve 125 is opened, refrigerant will pass through the sixth refrigerant line 196 to the water heat exchanger 175.

The refrigerant will pass through the sixth refrigerant line 196 to the second refrigerant port on the water heat exchanger 175, where it will enter the water heat exchanger 175.

The superheated refrigerant is then cooled at the water heat exchanger 175 through a condensation operation in a water-heating coil in the water heat exchanger 175 to desuperheat the refrigerant. In this condensation operation, the refrigerant in the water heat exchanger 175 will give up heat to the water in the water heater 180. This desuperheating condensation operation drops the enthalpy of the refrigerant while maintaining its pressure as the refrigerant moves from the superheated seventh state 740 to a tenth state 770 located on the pressure-enthalpy curve 310.

The refrigerant may then be further cooled at the water heat exchanger 175 through a partial condensation operation in a water-heating coil in the water heat exchanger 175. In this partial condensation operation, the refrigerant in the water heat exchanger 175 will give up more heat to the water in the water heater 180. This partial condensation operation drops the enthalpy of the refrigerant while maintaining its pressure as the refrigerant moves from the tenth state 770 to an eleventh state 780.

The enthalpy of the refrigerant in the eleventh state 780 is generally higher than the enthalpy in the eighth state 750 where an expansion operation should be performed. In other words, once the refrigerant has transferred as much heat to the water in the water heater 180 as the water can take, there is still heat left to dissipate in the refrigerant.

The precise enthalpy value of the eleventh state 780 is not fixed. Rather, it will vary with the temperature of the water in the water heater 180. The hotter that water is, the higher the enthalpy of the eleventh state 780. Similarly, the cooler that water is, the lower the enthalpy of the eleventh state 780.

After exchanging heat with the water in the water heater 180, the refrigerant then passes out the first refrigerant port in the water heat exchanger 175 to the seventh refrigerant line 197. Because the second expansion valve 155 is fully closed and the second controllable valve 125 is open, the refrigerant will flow through the seventh refrigerant line 197 to the first outdoor port of the outdoor air heat exchanger 110 and into the outdoor coil 140 of the outdoor air heat exchanger 110.

The refrigerant is then further cooled at the outdoor air heat exchanger 110 through a final condensation operation in the outdoor coil 140. In this final condensation operation, the refrigerant in the outdoor coil 140 will give up heat to the outdoor air. This operation drops the enthalpy of the refrigerant while maintaining its pressure as the refrigerant moves from the eleventh state 780 to the eighth state 750. As shown in FIG. 7, the refrigerant can be subcooled in the eighth state 750.

The cooled refrigerant then passes from the outdoor coil 140, through the refrigerant distributor 145 to the second outdoor port of the outdoor air heat exchanger 110 and then to the fifth refrigerant line 195. The cooled refrigerant then passes through the fifth refrigerant line 195, the first expansion valve 150, and the third expansion valve 160 to the second indoor port of the indoor air heat exchanger 170.

Since the first expansion valve 150 is fully open, the refrigerant will pass through the first expansion valve 150 unchanged. However, since the third expansion valve 160 is set to control flow, the refrigerant is expanded as it passes through the third expansion valve 160 to lower its pressure and moves from the eighth state 750 to the ninth state 760.

The refrigerant then absorbs heat at the indoor air heat exchanger 170 through an evaporation operation at an indoor coil in the indoor air heat exchanger 170, thereby cooling the indoor air. In other words, in this operation, the refrigerant exchanges heat with the indoor air. This evaporation operation raises the enthalpy of the refrigerant while maintaining its pressure as the refrigerant moves from the ninth state 760 back to the sixth state 730.

The evaporated refrigerant is then provided to the first indoor port of the indoor air heat exchanger 170, to the fourth refrigerant line 194, and through the fourth refrigerant line 194 to the four-way valve 135.

Since the four-way valve 135 is in the first configuration, the refrigerant will pass from the fourth refrigerant line 194, through the four-way valve 135, and to the second refrigerant line 192. The refrigerant will then pass through the second refrigerant line 192, by way of the accumulator 185, to the compressor 105. In the compressor 105, the refrigerant will again be compressed to change it from the sixth state 730 to the seventh state 740, and the cycle will continue.

As shown in FIGS. 6 and 7, the refrigeration cycle device 100 will continue to operate according to the second refrigeration cycle 720. During this second refrigeration cycle 720, the refrigerant will give up heat at the water heat exchanger 175 and the outdoor air heat exchanger 110 and will absorb heat at the indoor air heat exchanger 170, thereby performing a heat recovery operation using active heating that heats the water and cools the indoor space.

As shown in FIGS. 6 and 8, during the heat recovery operation using passive water heating, the refrigerant is compressed at the compressor 105 to move the refrigerant in the first state 330 to refrigerant in the second state 340, increasing the pressure and the temperature of the refrigerant. As shown in FIG. 8, the refrigerant can be superheated at the first state 330 and will be superheated at the second state 340. As noted above, the refrigerant in the second state 340 during the heat recovery operation using passive water heating has the same enthalpy and pressure as the second state 340 in the cooling space only operation. In other words, the refrigerant is provided with the same heat and pressure by the compressor 105 in the heat recovery operation using passive water heating as it would in a cooling space only operation.

The compressor 105 outputs the compressed refrigerant at the compressor output port to the sixth refrigerant line 196. Since the third controllable valve 130 is closed, the refrigerant will not flow through the first refrigerant line 191 to the four-way valve 135. Since the second controllable valve 125 is opened, refrigerant will pass through the sixth refrigerant line 196 to the water heat exchanger 175.

The refrigerant will pass through the sixth refrigerant line 196 to the second refrigerant port on the water heat exchanger 175, where it will enter the water heat exchanger 175.

The superheated refrigerant is then cooled at the water heat exchanger 175 through a condensation operation in a water-heating coil in the water heat exchanger 175 to desuperheat the refrigerant. In this condensation operation, the refrigerant in the water heat exchanger 175 will give up heat to the water in the water heater 180. This desuperheating condensation operation drops the enthalpy of the refrigerant while maintaining its pressure as the refrigerant moves from the superheated second state 340 to a twelfth state 870 located on the pressure-enthalpy curve 310.

The refrigerant may then be further cooled at the water heat exchanger 175 through a partial condensation operation in a water-heating coil in the water heat exchanger 175. In this partial condensation operation, the refrigerant in the water heat exchanger 175 will give up more heat to the water in the water heater 180. This partial condensation operation drops the enthalpy of the refrigerant while maintaining its pressure as the refrigerant moves from the twelfth state 870 to a thirteenth state 880.

The enthalpy of the refrigerant in the thirteenth state 880 is generally higher than the enthalpy in the third state 350 where an expansion operation should be performed. In other words, once the refrigerant has transferred as much heat to the water in the water heater 180 as the water can take, there is still heat left to dissipate in the refrigerant. The enthalpy of the refrigerant in the thirteenth state 880 is also generally higher than the enthalpy in the eleventh state 780. In other words, the refrigerant gives up less heat to the water in the water heater 180 in the heat recovery operation using passive water heating than it does in the heat recovery operation using active water heating.

The precise enthalpy value of the thirteenth state 880 is not fixed. Rather, it will vary with the temperature of the water in the water heater 180. The hotter that water is, the higher the enthalpy of the thirteenth state 880. Similarly, the cooler that water is, the lower the enthalpy of the thirteenth state 880.

The refrigerant then passes out the first refrigerant port in the water heat exchanger 175 to the seventh refrigerant line 197. Because the second expansion valve 155 is fully closed and the second controllable valve 125 is open, the refrigerant will flow through the seventh refrigerant line 197 to the first outdoor port of the outdoor air heat exchanger 110 and into the outdoor coil 140 of the outdoor air heat exchanger 110.

The refrigerant is then further cooled at the outdoor air heat exchanger 110 through a condensation operation in the outdoor coil 140. In this condensation operation, the refrigerant in the outdoor coil 140 will give up heat to the outdoor air. This operation drops the enthalpy of the refrigerant while maintaining its pressure as the refrigerant moves from the thirteenth state 880 to the third state 350. As shown in FIG. 8, the refrigerant can be subcooled in the third state 350.

The cooled refrigerant is then passed from the outdoor coil 140, through the refrigerant distributor 145 to the second outdoor port of the outdoor air heat exchanger 110 and then to the fifth refrigerant line 195. The cooled refrigerant will then pass through the fifth refrigerant line 195, the first expansion valve 150, and the third expansion valve 160 to the second indoor port of the indoor air heat exchanger 170.

Since the first expansion valve 150 is fully open, the refrigerant will pass through the first expansion valve 150 unchanged. However, since the third expansion valve 160 is set to control flow, the refrigerant is expanded as it passes through the third expansion valve 160 to lower its pressure and move from the third state 350 to the fourth state 360.

The refrigerant then absorbs heat at the indoor air heat exchanger 170 through an evaporation operation at an indoor coil in the indoor air heat exchanger 170, thereby cooling the indoor air. In other words, in this operation, the refrigerant exchanges heat with the indoor air. This evaporation operation raises the enthalpy of the refrigerant while maintaining its pressure as the refrigerant moves from the fourth state 360 back to the first state 330.

The evaporated refrigerant is then provided to the first indoor port of the indoor air heat exchanger 170, to the fourth refrigerant line 194, and through the fourth refrigerant line 194 to the four-way valve 135.

Since the four-way valve 135 is in the first configuration, the refrigerant passes from the fourth refrigerant line 194, through the four-way valve 135, and to the second refrigerant line 192. The refrigerant then passes through the second refrigerant line 192, by way of the accumulator 185, to the compressor 105. In the compressor 105 the refrigerant will again be compressed to change it from the first state 330 to the second state 340, and the cycle will continue.

As shown in FIGS. 6 and 8, the refrigeration cycle device 100 will continue to operate according to the first refrigeration cycle 320. During this first refrigeration cycle 320, the refrigerant will give up heat at the water heat exchanger 175 and the outdoor air heat exchanger 110 and will absorb heat at the indoor air heat exchanger 170, thereby performing a heat recovery operation using passive heating that heats the water and cools the indoor space.

Figure 9:
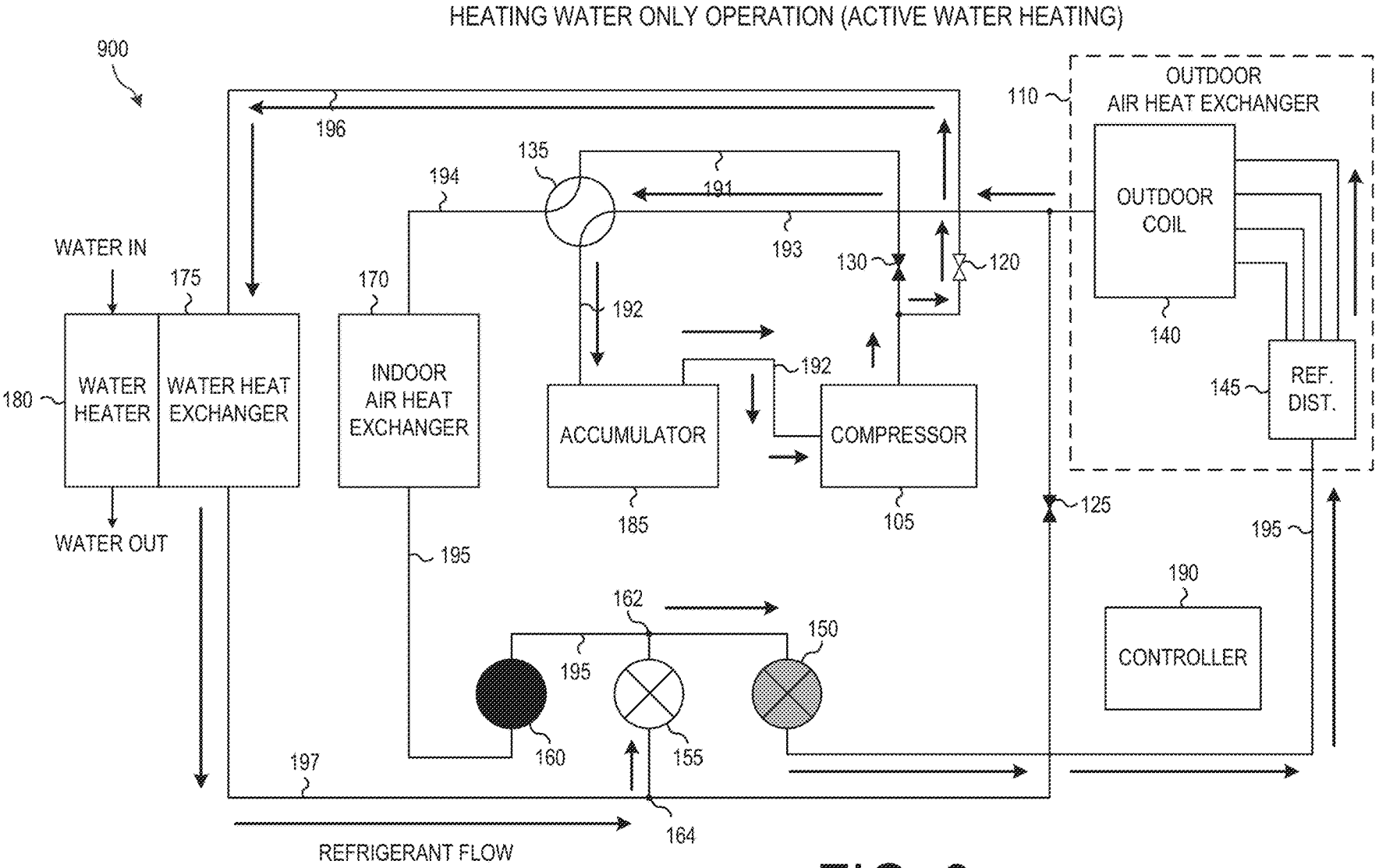
FIG. 9 is a diagram of the refrigeration cycle device of FIG. 1 in an active water heating operation according to disclosed embodiments.

The arrangement of FIGS. 7-9 work more efficiently than an arrangement in which the refrigerant was selectively routed only though the water heat exchanger 175 or only through the outdoor air heat exchanger 100. If the refrigerant were routed only through the water heat exchanger 175 for a condensation operation, the cooling capacity of the system would be limited by how much heat could be discharged into the water in the water heater 180. If the water in the water heater 180 was already hot, then the amount of heat that could be discharged into the water would be limited. This, in turn, would limit the ability of the refrigerant to dissipate sufficient heat to operate in a desirable manner.

However, by routing the refrigerant through both the water heat exchanger 175 and the outdoor air heat exchanger 110 in the heat recovery operation using either active or passive water heating, the refrigeration cycle device 100 avoids this problem. As a result, the cooling capacity of the system is not limited by how much heat can be discharged into the water in the water heater 180. Rather whatever heat can be discharged into the water in the water heater 180 will be discharged into the water and the remainder of the heat that must be discharged will be discharged to outdoor air in the outdoor air heat exchanger 110.

Active Water Heating Operation

FIG. 9 is a diagram 900 of the refrigeration cycle device 100 of FIG. 1 in an active water heating operation according to disclosed embodiments. During the active water heating operation, the water heat exchanger 175 operates to heat the water in the water heater 180 and the indoor air heat exchanger 170 does not operate to heat the indoor air in the indoor space.

As shown in FIG. 9, during the active water heating operation, the four-way valve 135, the first, second, and third controllable valves 120, 125, 130, and the first, second, and third expansion valves 150, 155, 160 are set as follows. The four-way valve 135 is set in the second configuration in which the compressor output port of the compressor 105 is connected to the first outdoor port of the indoor air heat exchanger 170 and the first outdoor port of the outdoor air heat exchanger 110 is connected to the accumulator 185. The second and third controllable valves 125, 130 are set to be closed and the first controllable valve 120 is set to be opened. The first expansion valve 150 is set to be controlling flow; the second expansion valve 155 is set to be fully opened; and the third expansion valve 160 is set to be fully closed.

Figure 10:
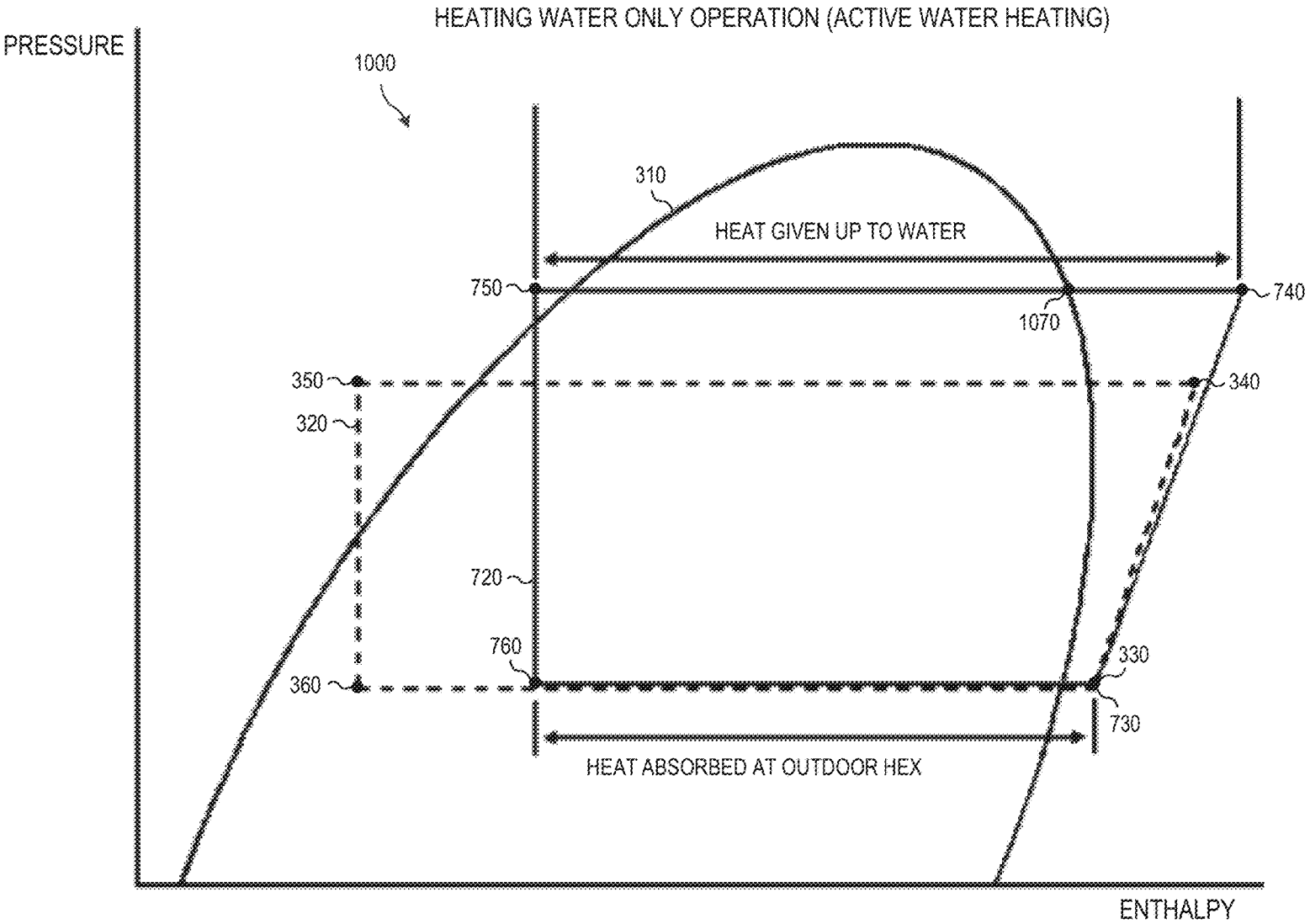
FIG. 10 is a graph of the refrigeration cycle of the refrigeration cycle device of FIG. 1 in the active water heating operation of FIG. 9 according to disclosed embodiments.

FIG. 10 is a graph 1000 of the refrigeration cycle of the refrigeration cycle device 100 of FIG. 1 in the active water heating operation of FIG. 9 according to disclosed embodiments. As shown in FIG. 10, the graph 1000 shows a pressure-enthalpy curve 310, a first refrigeration cycle 320, and a second refrigeration cycle 720.

The pressure-enthalpy curve 310 and the first refrigeration cycle 320 are just as is shown in FIG. 3. For purposes of simplifying the disclosure, their description will not be repeated here.

The second refrigeration cycle 720 represents the state of the refrigerant as it passes through the refrigeration cycle device 100 during the active water heating operation. The refrigerant passes through a cycle of compression, condensation, expansion, and evaporation, as it passes through the second refrigeration cycle 720. Compression takes place from a sixth state 730 to a seventh state 740; condensation takes place from the seventh state 740 to an eighth state 750; expansion takes place from the eighth state 750 to an ninth state 760; and evaporation takes place from the eighth state 750 to the sixth state 730. The sixth state 730 is at a relatively high enthalpy and a lowest pressure; the seventh state 740 is at a highest enthalpy and pressure; the eighth state 750 is at a highest pressure and lowest enthalpy; and the ninth state 760 is at the lowest pressure and enthalpy.

In the embodiment disclosed in FIGS. 9 and 10, the sixth state 730 is at a similar pressure and enthalpy as the first state 330; the seventh state 740 is at a higher pressure and enthalpy as the second state 340; the eighth state 750 is at a higher pressure and a higher enthalpy as the third state; and the ninth state 760 is at a similar pressure and a higher enthalpy as the fourth state 360.

As shown in FIGS. 9 and 10, the refrigerant is compressed at the compressor 105 to move the refrigerant in the sixth state 730 to refrigerant in the seventh state 740, increasing the pressure and the temperature of the refrigerant. The refrigerant can be superheated at the sixth state 730 and will be superheater in the seventh state 740. As noted above, the refrigerant in the seventh state 740 has a higher enthalpy and pressure than the refrigerant in the second state 340. In other words, the refrigerant is provided with more heat and pressure by the compressor 105 in the heat recovery operation using active water heating than it is in a heating space only operation.

The compressor 105 outputs the compressed refrigerant at the compressor output port to the sixth refrigerant line 196. Since the third controllable valve 130 is closed, the refrigerant will not flow through the first refrigerant line 191 to the four-way valve 135. Since the first controllable valve 120 is open, refrigerant passes through the sixth refrigerant line 196 to the water heat exchanger 175.

The refrigerant will pass through the sixth refrigerant line 196 to the second refrigerant port on the water heat exchanger 175, where it will enter the water heat exchanger 175.

The superheated refrigerant is then cooled at the water heat exchanger 175 through a condensation operation in a water-heating coil in the water heat exchanger 175 to desuperheat the refrigerant. In this condensation operation, the refrigerant in the water heat exchanger 175 will give up heat to the water in the water heater 180. This desuperheating condensation operation drops the enthalpy of the refrigerant while maintaining its pressure as the refrigerant moves from the superheated seventh state 740 to the thirteenth state 1070 located on the pressure-enthalpy curve 310.

The superheated refrigerant is then further cooled at the water heat exchanger 175 through a continued condensation operation in a water-heating coil in the water heat exchanger 175. In this condensation operation, the refrigerant in the water heat exchanger 175 will give up more heat to the water in the water heater 180. This cooling operation drops the enthalpy of the refrigerant while maintaining its pressure as the refrigerant moves from the thirteenth state 1070 to the eighth state 750. As shown in FIG. 10, the refrigerant can be subcooled in the eighth state 750.

Since the indoor air heat exchanger 170 is not provided any refrigerant, the water heat exchanger 175 must dissipate all the heat from the refrigerant during the condensation operation. As a result, the active water heating operation is usually selected when the water in the water heater 180 has a large capacity to absorb heat, e.g., there is a lot of water in the water heater 180 or the water in the water heater 180 is very cold.

The cooled refrigerant is then passed through the first refrigerant port of the water heat exchanger 175 to the seventh refrigerant line 197. The cooled refrigerant will then pass through the seventh refrigerant line 197 to the second intermediate node 164, through the second expansion valve 155 to the first intermediate node 162, and through the fifth refrigerant line 195 and the first expansion valve 150 to the second outdoor port of the outdoor air heat exchanger 110. From there it passes through the refrigerant distributor 145 to the outdoor coil 140.

Since the second controllable valve 125 is closed, the refrigerant will not pass through the portion of the seventh refrigerant line 197 between the second intermediate node 164 and the first outdoor port of the outdoor air heat exchanger 110. Since the second expansion valve 155 is fully open, the refrigerant will pass through the second expansion valve 155 unchanged. Since the third expansion valve 160 is fully closed, the refrigerant will not pass through the portion of the fifth refrigerant line 195 between the first intermediate node 162 and the second indoor port on the indoor air heat exchanger 170. However, since the first expansion valve 150 is set to control flow, the refrigerant is expanded as it passes through the first expansion valve 150 to lower its pressure and move from the eighth state 750 to the ninth state 760.

The refrigerant then absorbs heat at the outdoor air heat exchanger 170 through an evaporation operation at the outdoor coil 140 in the outdoor air heat exchanger 110. In other words, in this operation, the refrigerant exchanges heat with the outdoor air. This evaporation operation raises the enthalpy of the refrigerant while maintaining its pressure as the refrigerant moves from the ninth state 760 back to the sixth state 730.

The evaporated refrigerant is then provided to the first outdoor port of the outdoor air heat exchanger 110, to the third refrigerant line 193, and through the third refrigerant line 193 to the four-way valve 135.

Since the four-way valve 135 is in the second configuration, the refrigerant will pass from the third refrigerant line 193, through the four-way valve 135, and to the second refrigerant line 192. The refrigerant will then pass through the second refrigerant line 192, by way of the accumulator 185, to the compressor 105. In the compressor 105 the refrigerant will again be compressed to change it from the sixth state 730 to the seventh state 740, and the cycle will continue.

As shown in FIGS. 9 and 10, the refrigeration cycle device 100 will continue to operate according to the second refrigeration cycle 720. During this second refrigeration cycle 720, the refrigerant will give up heat at the water heat exchanger 175 and absorb heat at the outdoor air heat exchanger 110, thereby performing an active water heating operation that heats the water in the water heater 180.

Active Water Heating and Space Heating Operation

Figure 11:
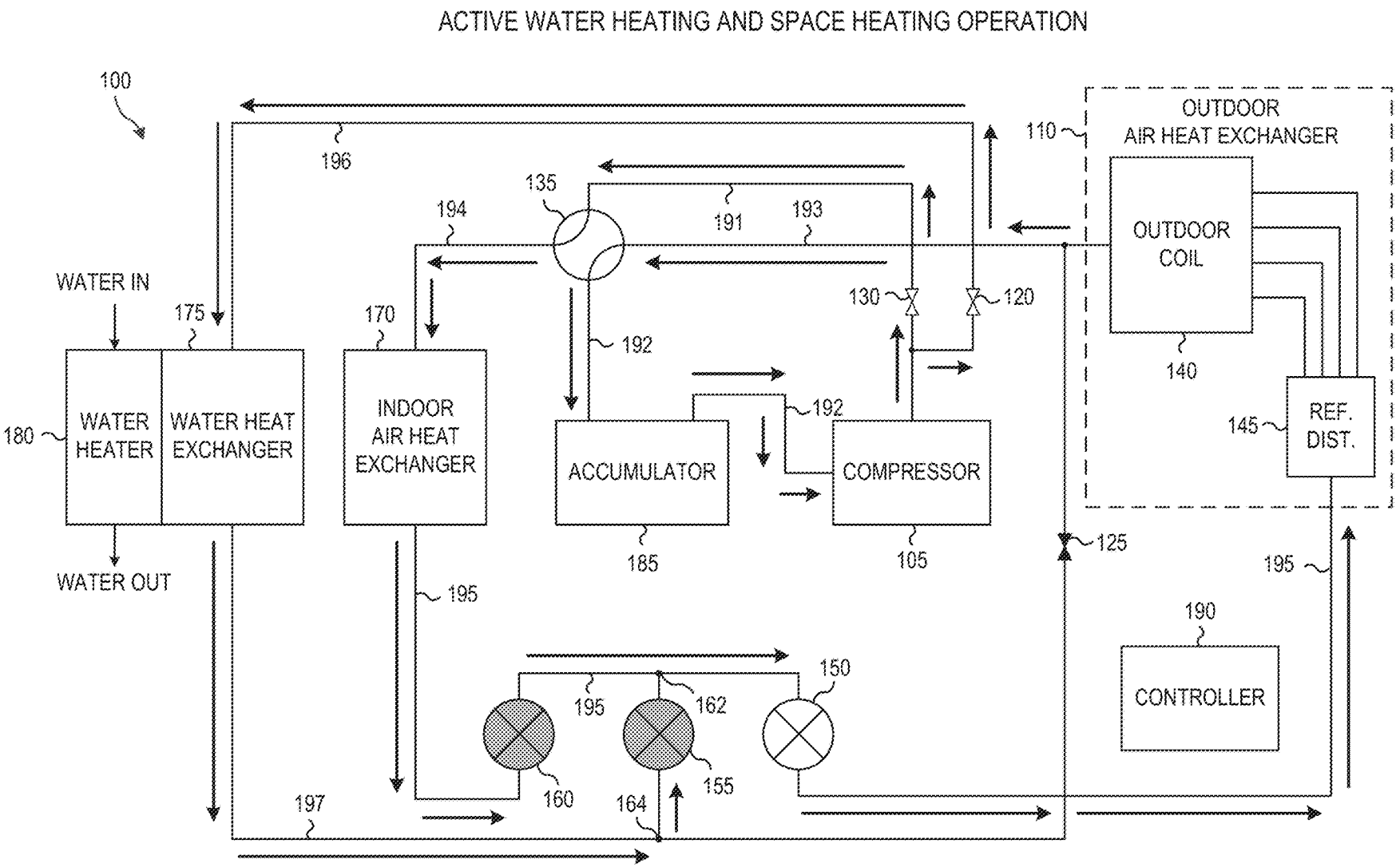
FIG. 11 is a diagram of the refrigeration cycle device of FIG. 1 in an active water heating and space heating operation according to disclosed embodiments.

FIG. 11 is a diagram 1100 of the refrigeration cycle device 100 of FIG. 1 in an active water heating and space heating operation according to disclosed embodiments. During the active water heating and space heating operation, the water heat exchanger 175 operates to heat the water in the water heater 180 and the indoor air heat exchanger 170 operates to heat the indoor air in the indoor space.

As shown in FIG. 11, during the active water heating operation, the four-way valve 135, the first, second, and third controllable valves 120, 125, 130, and the first, second, and third expansion valves 150, 155, 160 are set as follows. The four-way valve 135 is set in the second configuration in which the compressor output port of the compressor 105 is connected to the first outdoor port of the indoor air heat exchanger 170 and the first outdoor port of the outdoor air heat exchanger 110 is connected to the accumulator 185. The second controllable valve 125 is set to be closed and the first and third controllable valves 120, 130 are set to be opened. The first expansion valve 150 is set to be fully opened; and the second and third expansion valves 155, 160 are set to be controlling flow.

Figure 12:
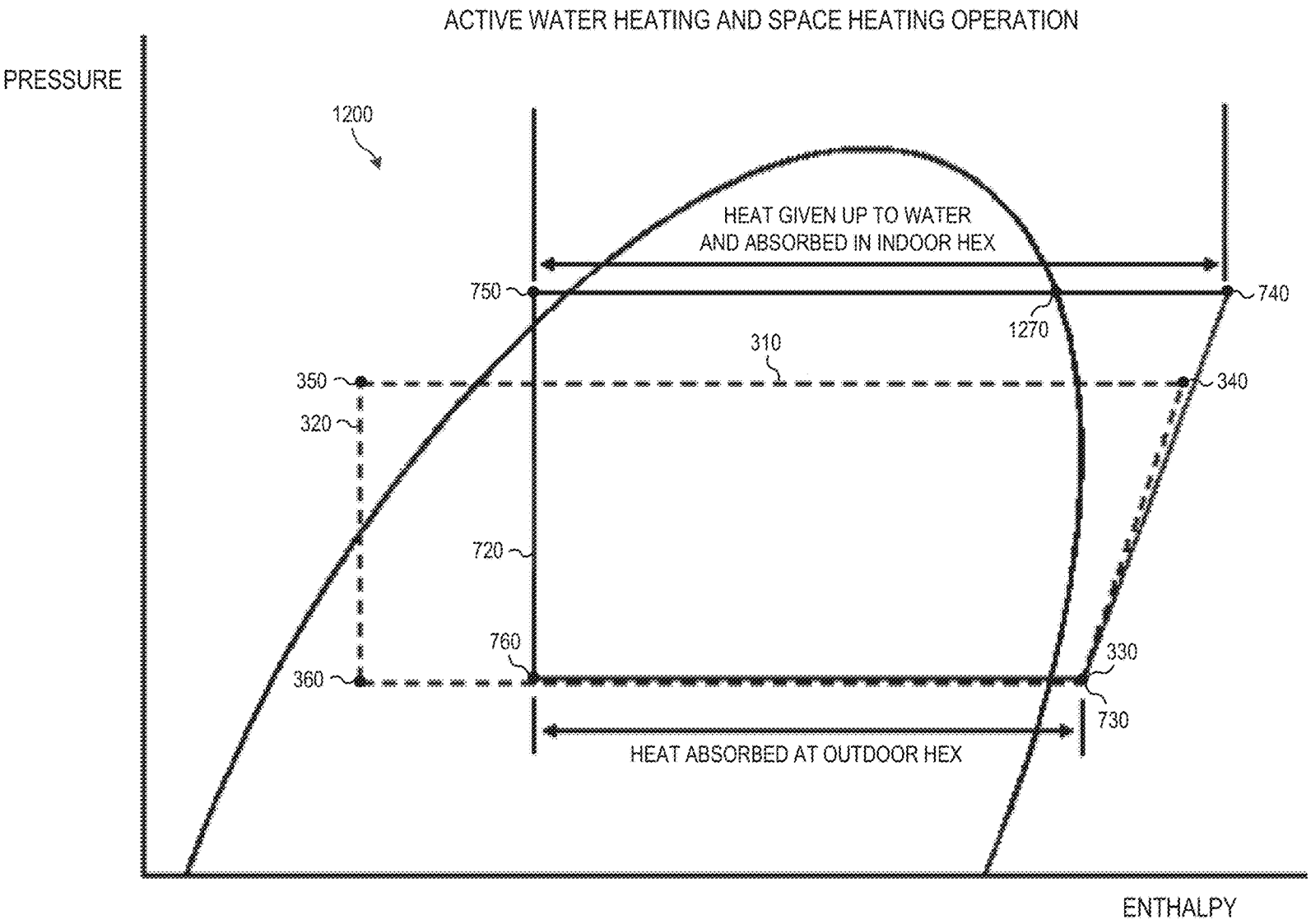
FIG. 12 is a graph of the refrigeration cycle of the refrigeration cycle device of FIG. 1 in the active water heating and space heating operation of FIG. 11 according to disclosed embodiments.

FIG. 12 is a graph 1200 of the refrigeration cycle of the refrigeration cycle device 100 of FIG. 1 in the active water heating and space heating operation of FIG. 11 according to disclosed embodiments. As shown in FIG. 12, the graph 1200 shows a pressure-enthalpy curve 310, a first refrigeration cycle 320, and a second refrigeration cycle 720.

The pressure-enthalpy curve 310 and the first refrigeration cycle 320 are just as is shown in FIG. 3. For purposes of simplifying the disclosure, their description will not be repeated here.

The second refrigeration cycle 720 represents the state of the refrigerant as it passes through the refrigeration cycle device 100 during the active water heating and space heating operation. The refrigerant passes through a cycle of compression, condensation, expansion, and evaporation, as it passes through the second refrigeration cycle 720. Compression takes place from a sixth state 730 to a seventh state 740; condensation takes place from the seventh state 740 to an eighth state 750; expansion takes place from the eighth state 750 to an ninth state 760; and evaporation takes place from the eighth state 750 to the sixth state 730. The sixth state 730 is at a relatively high enthalpy and a lowest pressure; the seventh state 740 is at a highest enthalpy and pressure; the eighth state 750 is at a highest pressure and lowest enthalpy; and the ninth state 760 is at the lowest pressure and enthalpy.

In the embodiment disclosed in FIGS. 11 and 12, the sixth state 730 is at a similar pressure and enthalpy as the first state 330; the seventh state 740 is at a higher pressure and enthalpy as the second state 340; the eighth state 750 is at a higher pressure and a higher enthalpy as the third state; and the ninth state 760 is at a similar pressure and a higher enthalpy as the fourth state 360.

As shown in FIGS. 11 and 12, the refrigerant is compressed at the compressor 105 to move the refrigerant in the sixth state 730 to refrigerant in the seventh state 740, increasing the pressure and the temperature of the refrigerant. The refrigerant can be superheated at the sixth state 730 and will be superheater in the seventh state 740.

The compressor 105 outputs the compressed refrigerant at the compressor output port to the first refrigerant line 191 and the sixth refrigerant line 196 in parallel. Since the first and third controllable valves 120, 130 are open, refrigerant passes from the compressor output port through the first refrigerant line 191 to the four-way valve 135 and through the sixth refrigerant line 196 to the water heat exchanger 175.

Since the four-way valve 135 is in the second configuration, the refrigerant received from the first refrigerant line 191 will pass through the four-way valve 135 to the fourth refrigerant line 194. The refrigerant will then pass through the fourth refrigerant line 194 to the first indoor port of the indoor air heat exchanger 170.

The superheated refrigerant is then cooled at the indoor air heat exchanger 110 through a condensation operation in an indoor coil in the indoor air heat exchanger 170. In this condensation operation, the refrigerant in the outdoor coil 140 will give up heat to the indoor air, thereby heating the indoor space.

Simultaneously to passing through the indoor air heat exchanger and transferring heat to the indoor air in the indoor space, the refrigerant will also pass through the sixth refrigerant line 196 to the second refrigerant port on the water heat exchanger 175, where it will enter the water heat exchanger 175.

The superheated refrigerant is then cooled at the water heat exchanger 175 through a condensation operation in a water-heating coil in the water heat exchanger 175. In this condensation operation, the refrigerant in the water heat exchanger 175 will give up heat to the water in the water heater 180, thereby heating the water.

The combination of heat exchange in the indoor air heat exchanger 170 and the water heat exchanger 175 drops the enthalpy of the refrigerant while maintaining its pressure as the refrigerant moves from the seventh state 740 to the eighth state 750. In moving from the seventh state 740 to the eighth state 750, the refrigerant will pass through a fourteenth state 1270 on the pressure-enthalpy curve 310 where desuperheating of the refrigerant is completed. As shown in FIG. 12, the refrigerant can be subcooled in the eighth state 750.

The cooled refrigerant from the indoor air heat exchanger 170 passes through the second indoor port of the indoor air heat exchanger 170 to the fifth refrigerant line 195. The cooled refrigerant then passes through the fifth refrigerant line 195 and the third expansion valve 160 to the first intermediate node 162 on the fifth refrigerant line 195.

The cooled refrigerant from the water heat exchanger 175 passes through the first refrigerant port of the water heat exchanger 175 to the seventh refrigerant line 197. The cooled refrigerant then passes through the seventh refrigerant line 197 to the second intermediate node 164, and through the second expansion valve 155 to the first intermediate node 162 on the fifth refrigerant line 195.

Since the second and third expansion valves 155, 160 are set to control flow, the refrigerant is expanded as it passes through the second and third expansion valves 155, 160 to lower its pressure and move from the third state 350 to the fourth state 360.

At the first intermediate node 162, the refrigerant from the indoor air heat exchanger 170 and the refrigerant from the water heat exchanger 175 are combined. Since each flow of refrigerant has been expanded through a respective expansion valve 155, 160, the combined refrigerant flow is at the fourth state 360.

The combined refrigerant flow then continues along the fifth refrigerant line 185, through the first expansion valve 150 to the second outdoor port on the outdoor air heat exchanger 110. Since the first expansion valve 150 is fully open, the refrigerant will pass through the first expansion valve 150 unchanged and along the fifth refrigerant line 195 to the refrigerant distributor 145 and the outdoor coil 140 in the outdoor air heat exchanger 110.

The refrigerant then absorbs heat at the outdoor air heat exchanger 170 through an evaporation operation at the outdoor coil 140 in the outdoor air heat exchanger 110. In other words, in this operation, the refrigerant exchanges heat with the outdoor air. This evaporation operation raises the enthalpy of the refrigerant while maintaining its pressure as the refrigerant moves from the fourth state 360 back to the first state 330.

The evaporated refrigerant is then provided to the first outdoor port of the outdoor air heat exchanger 110, to the third refrigerant line 193, and through the third refrigerant line 193 to the four-way valve 135.

Since the four-way valve 135 is in the second configuration, the refrigerant will pass from the third refrigerant line 193, through the four-way valve 135, and to the second refrigerant line 192. The refrigerant will then pass through the second refrigerant line 192, by way of the accumulator 185, to the compressor 105. In the compressor 105 the refrigerant will again be compressed to change it from the sixth state 730 to the seventh state 740, and the cycle will continue.

As shown in FIGS. 11 and 12, the refrigeration cycle device 100 will continue to operate according to the second refrigeration cycle 720. During this second refrigeration cycle 720, the refrigerant will give up heat at the indoor air heat exchanger 170 and the water heat exchanger 175 and will absorb heat at the outdoor air heat exchanger 110, thereby performing an active water heating and space heating operation that simultaneously heats the indoor air in the indoor space and heats the water in the water heater 180.

Method of Operating a Refrigeration Cycle Device

Figure 13:
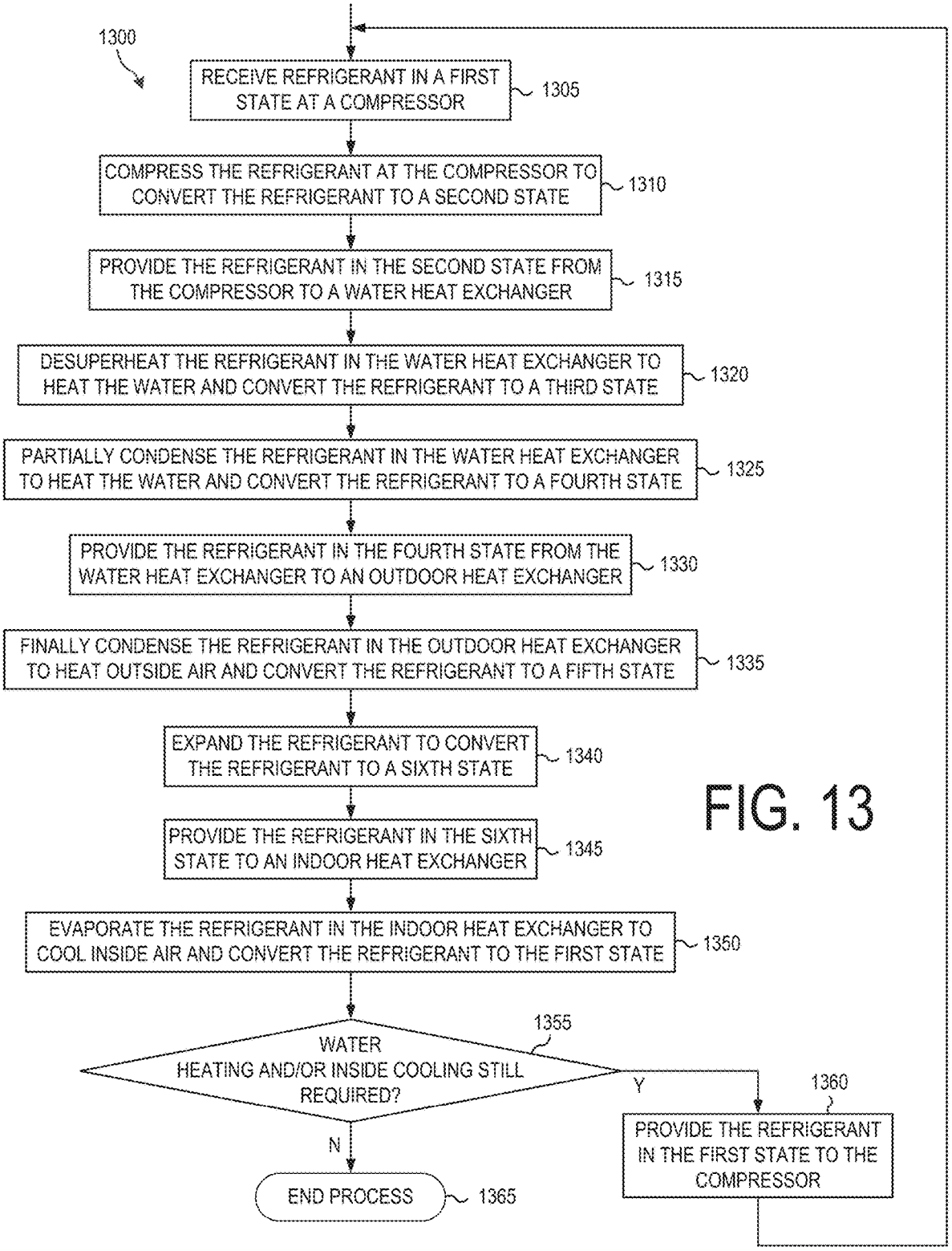
FIG. 13 is a flow chart showing the operation a refrigeration cycle device according to disclosed embodiments.

FIG. 13 is a flow chart showing the operation 1300 a refrigeration cycle device according to disclosed embodiments. In these embodiments the refrigeration cycle device will simultaneously heat water in a water heater and cool indoor air in an indoor space.

As shown in FIG. 13, the operation 1300 begins by receiving a refrigerant in a first state at a compressor (1305). This first state will typically be at a low pressure and a high enthalpy. The refrigerant may be superheated in the first state.

The refrigerant will then be compressed at the compressor to convert the refrigerant to a second state (1310). This second state will typically be at a high pressure and a high enthalpy. The high enthalpy in the second state may be higher than the high enthalpy in the first state. The refrigerant is superheated in the second state.

The refrigerant is then provided in the second state from the compressor to a water heat exchanger (1315).

The refrigerant is then desuperheated in the water heat exchanger to heat the water and convert the refrigerant to a third state (1320). The third state is at a high pressure and a moderate enthalpy that is smaller than the enthalpy in the second state, but not at a minimum enthalpy for the refrigeration cycle.

The refrigerant is then partially condensed in the water heat exchanger to heat the water and convert the refrigerant to a fourth state (1325). The fourth state is at a high pressure and a moderate enthalpy that is smaller than the enthalpy in the third state, but not at the minimum enthalpy for the refrigeration cycle.

The refrigerant is then provided in the fourth state from the water heat exchanger to an outdoor air heat exchanger (1330).

The refrigerant is then finally condensed in the outdoor air heat exchanger to exchange heat with outside air and convert the refrigerant to a fifth state (1335). The fifth state is at a high pressure and a minimum enthalpy for the refrigeration cycle.

The refrigerant is then expanded to lower its pressure to convert the refrigerant to a sixth state (1340). The sixth state is at a low pressure and a minimum enthalpy for the refrigeration cycle.

The refrigerant at the sixth state is then provided to an indoor air heat exchanger (1345).

The refrigerant is then evaporated in the indoor air heat exchanger to cool inside air in an inside space and convert the refrigerant back to the first state (1350).

The process 1300 then determines whether water heating and/or inside cooling is still required (1355). If water heating and inside cooling is still required, then the refrigerant in the first state is again provided to the compressor (1360) and operation proceeds with the compressor receiving the refrigerant (1305). If water heating and/or inside cooling is no longer required, then processing ends (1365).

Method of Mode Determination in a Refrigeration Cycle Device

Figure 14A:
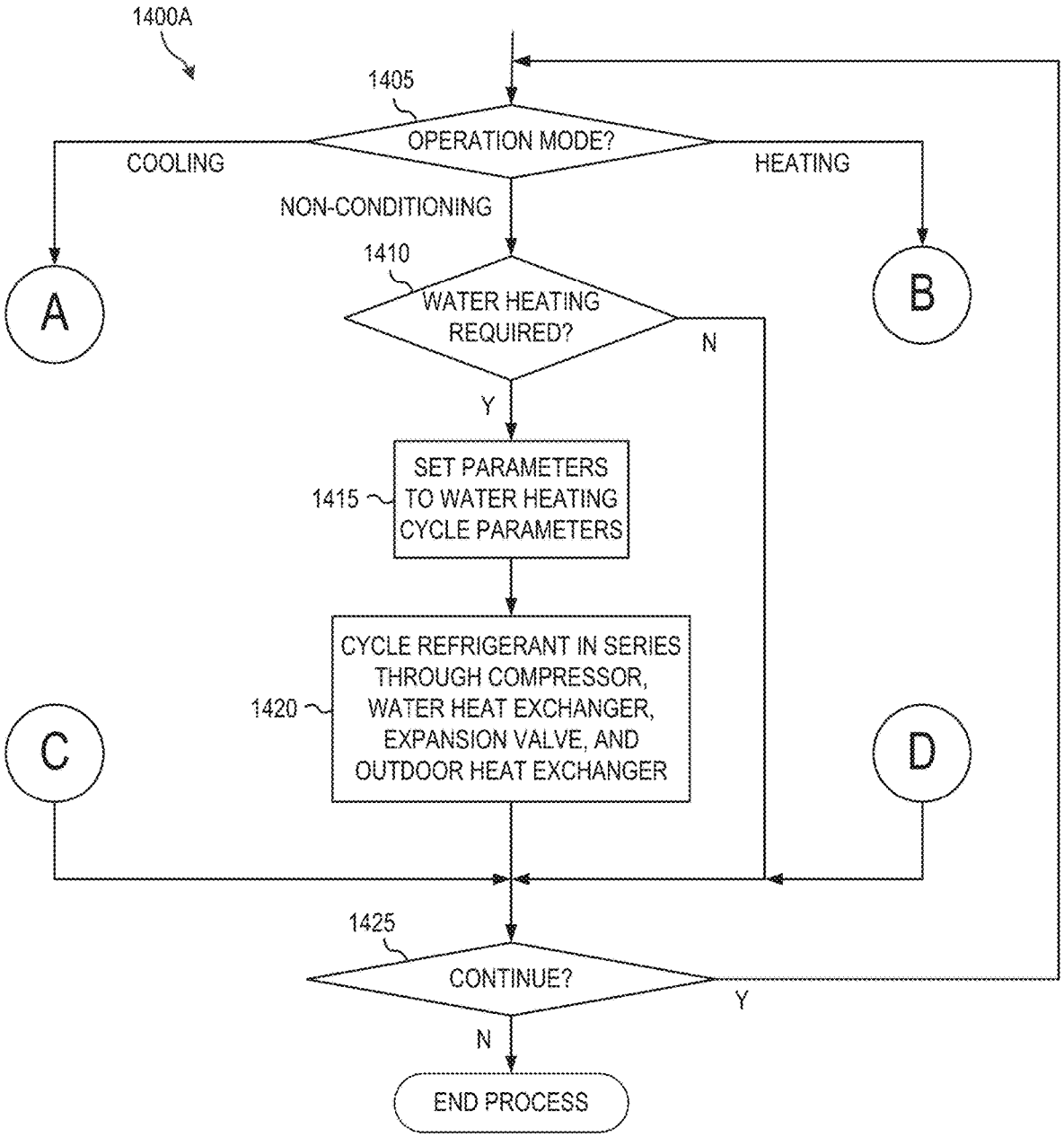
FIGS. 14A-14C are a flow chart showing a mode-determination operation of a refrigeration cycle device according to disclosed embodiments.
Figure 14B:
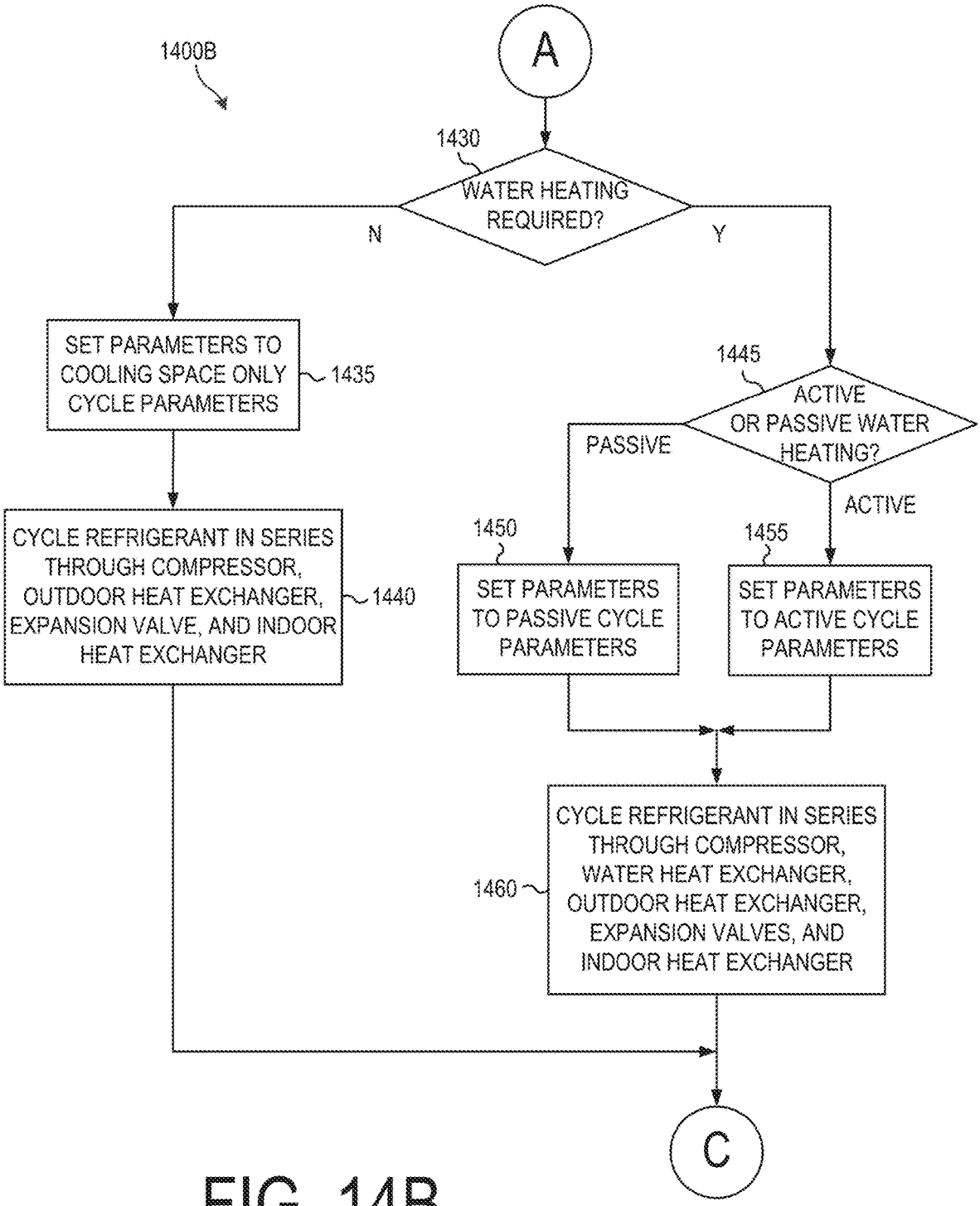
Figure 14C:
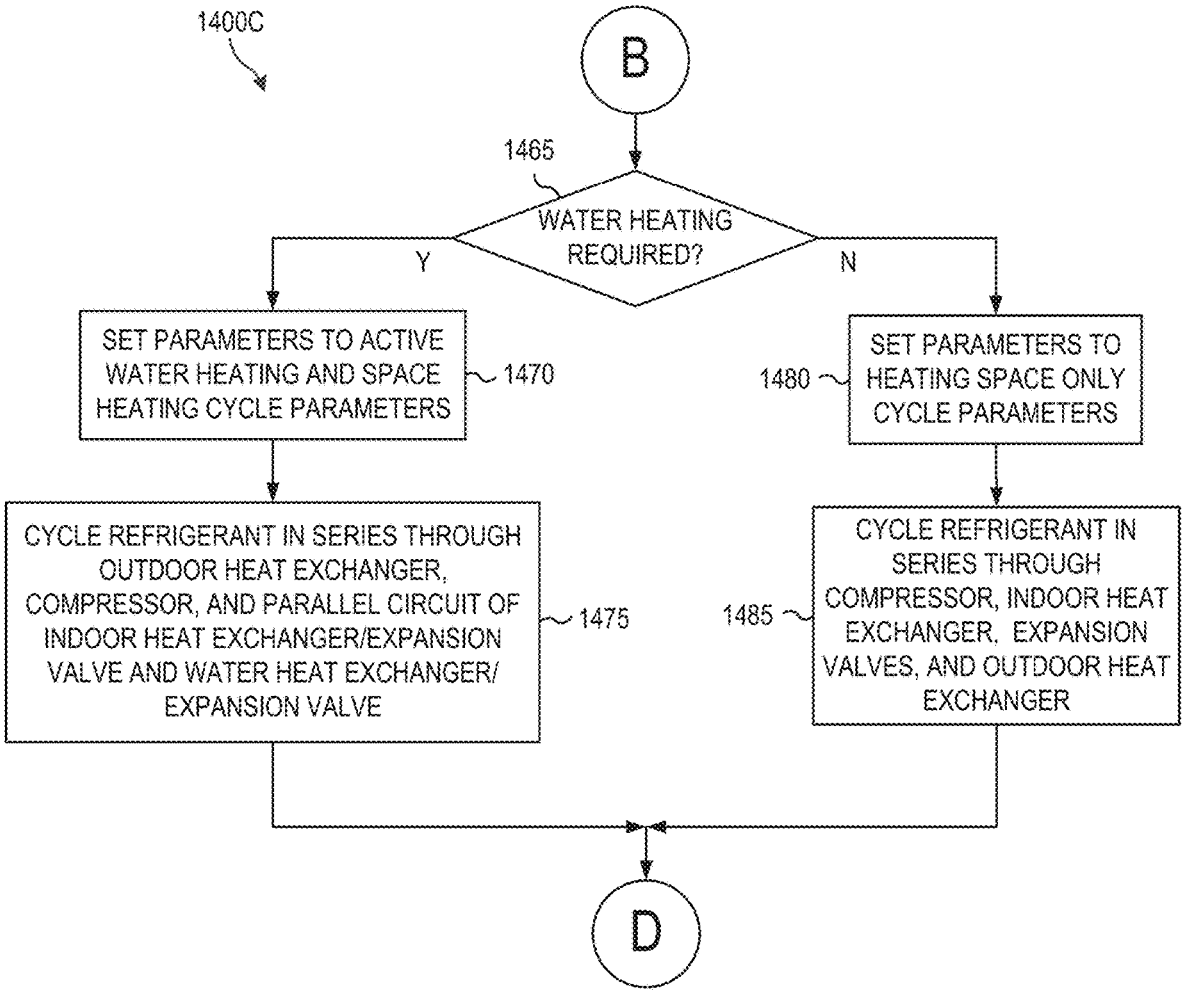

FIGS. 14A-14C are a flow chart 1400A, 1400B, 1400C showing a mode-determination operation of a refrigeration cycle device according to disclosed embodiments. Specifically, FIGS. 14A-14C show how a refrigeration cycle device selects between an air cooling space only mode, a cooling space and active water heating mode, a cooling space and passive water heating mode, a heating space only mode, an active water heating mode, an active water heating and space heating mode, and an off mode.

As shown in FIG. 14A, operation begins by determining a basic operation mode (1405). This basic operation mode can be a cooling mode, a heating mode, or a non-conditioning mode.

If a non-conditioning mode is selected (1405), then the operation determines whether water heating is required (1410).

If water heating is not required (1410), then the refrigeration cycle device will be in an off mode in which no air cooling, air heating, or water heating will be performed. In such a case, the compressor in the refrigeration cycle device can be turned off.

If water heating is required (1410), then the refrigeration cycle device will enter an active water heating mode in which only water heating is required. It will then set system parameters to active water heating cycle parameters (1415) and will cycle refrigerant in series through a compressor, a water heat exchanger, an expansion valve, and an outdoor air heat exchanger (1420). The water heating cycle parameters will control the elements in the refrigeration cycle device such that the refrigerant will flow through the compressor, the water heat exchanger, the expansion valve, and the outdoor air heat exchanger.

These elements will perform the necessary functions of a refrigeration cycle. The compressor will perform a compression operation on the refrigerant, the water heat exchanger will perform a condensation operation to heat water, the expansion valve will perform an expansion operation on the refrigerant, and the outdoor air heat exchanger will perform an evaporation operation to exchange heat with outside air.

Periodically, the system will determine whether the operation of the refrigeration cycle device should continue (1425). If the operation will continue, then it proceeds to again determine the operation mode (1405). If operation will not continue, then the process ends.

If a cooling mode is selected (1405), then the operation determines whether water heating is required (1430).

If water heating is not required (1430), then the refrigeration cycle device will be in a cooling space only mode in which only air cooling will be performed. It will then set system parameters to cooling space only cycle parameters (1435) and will cycle refrigerant in series through a compressor, an outdoor air heat exchanger, an expansion valve, and an indoor air heat exchanger (1440). The cooling space only cycle parameters will control the elements in the refrigeration cycle device such that the refrigerant will flow through the compressor, the outdoor air heat exchanger, the expansion valve, and the indoor air heat exchanger.

These elements will perform the necessary functions of a refrigeration cycle. The compressor will perform a compression operation on the refrigerant, the outdoor air heat exchanger will perform a condensation operation to exchange heat with outside air, the expansion valve will perform an expansion operation on the refrigerant, and the indoor air heat exchanger will perform an evaporation operation to cool inside air.

If water heating is required (1430), then the refrigeration cycle device will determine whether active or passive water heating is required (1445). Active water heating involves adding heat to the refrigeration cycle so that extra heat will be available to heat the water; and passive water heating will use only waste heat in the air-cooling operation to heat the water.

If passive water heating is selected (1445), then the refrigeration cycle device will be in a cooling space and passive water heating mode in which air cooling and water heating will be performed. It will then set system parameters to cooling space and passive water heating cycle parameters (1450) and will cycle refrigerant in series through a compressor, a water heat exchanger, an outdoor air heat exchanger, an expansion valve, and an indoor air heat exchanger in series (1455). The cooling space and passive water heating cycle parameters will control the elements in the refrigeration cycle device such that the refrigerant will properly flow through the compressor, the water heat exchanger, the outdoor air heat exchanger, the expansion valve, and the indoor air heat exchanger.

These elements will perform the necessary functions of a refrigeration cycle. The compressor will perform a compression operation on the refrigerant, the water heat exchanger and the outdoor air heat exchanger will perform a condensation operation to exchange heat with water to heat the water and with outside air, the expansion valve will perform an expansion operation on the refrigerant, and the indoor air heat exchanger will perform an evaporation operation to cool inside air.

If active water heating is selected (1445), then the refrigeration cycle device will be in a cooling space and active water heating mode in which air cooling and water heating will be performed. It will then set system parameters to cooling space and passive water heating cycle parameters (1450) and will cycle refrigerant in series through a compressor, a water heat exchanger, an outdoor air heat exchanger, an expansion valve, and an indoor air heat exchanger in series (1455). The cooling space and active water heating cycle parameters will control the elements in the refrigeration cycle device such that the refrigerant will flow through the compressor, the water heat exchanger, the outdoor air heat exchanger, the expansion valve, and the indoor air heat exchanger. These parameters will also instruct the compressor to add extra heat to the refrigerant during a compression operation.

These elements will perform the necessary functions of a refrigeration cycle. The compressor will perform a compression operation on the refrigerant, the water heat exchanger and the outdoor air heat exchanger will perform a condensation operation to exchange heat with water to heat the water and with outside air, the expansion valve will perform an expansion operation on the refrigerant, and the indoor air heat exchanger will perform an evaporation operation to cool inside air.

Once the refrigerant has been cycled through system elements (1455) in either the cooling space and passive water heating mode or the cooling space and active water heating mode, the system will determine whether the it should continue or not (1425) as noted above.

If a heating mode is selected (1405), then the operation determines whether water heating is required (1465).

If water heating is required (1465), then the refrigeration cycle device will be in an active water heating and heating space mode in which both air heating and water heating will be performed. It will then set system parameters to active water heating and heating space cycle parameters (1470) and will cycle refrigerant in series through an outdoor air heat exchanger, a compressor, and a parallel circuit of an indoor heat exchanger and a first expansion valve, and a water heat exchanger and a second expansion valve (1475). In other words, the refrigerant will always flow through the outdoor air heat exchanger and the compressor. However, the refrigerant will split after the compressor with part of the refrigerant flow passing through the indoor heat exchanger and the first expansion valve, and part of the refrigerant flow passing through the water heat exchanger and the second expansion valve. Refrigerant flowing out of the first and second expansion valves will be recombined before being provided to the outdoor air heat exchanger.

The active water heating and heating space cycle parameters will control the elements in the refrigeration cycle device such that the refrigerant will flow through the outdoor air heat exchanger, the compressor, and the parallel circuit of the indoor heat exchanger and the expansion valve, and the water heat exchanger and the expansion valve.

These elements will perform the necessary functions of a refrigeration cycle. The compressor will perform a compression operation on the refrigerant, the water heat exchanger and the indoor air heat exchanger will perform a condensation operation to exchange heat with water to heat the water and with inside air to heat the inside air, the first and second expansion valves will perform an expansion operation on the refrigerant, and the outdoor air heat exchanger will perform an evaporation operation to exchange heat with outside air.

If water heating is not required (1465), then the refrigeration cycle device will be in a heating space only mode in which only air heating will be performed. It will then set system parameters to heating space only cycle parameters (1480) and will cycle refrigerant in series through a compressor, an indoor air heat exchanger, an expansion valve, and an outdoor air heat exchanger (1485). The heating space only cycle parameters will control the elements in the refrigeration cycle device such that the refrigerant will flow through the compressor, the indoor air heat exchanger, the expansion valve, and the outdoor air heat exchanger.

These elements will perform the necessary functions of a refrigeration cycle. The compressor will perform a compression operation on the refrigerant, the indoor air heat exchanger will perform a condensation operation to heat the inside air, the expansion valve will perform an expansion operation on the refrigerant, and the outdoor air heat exchanger will perform an evaporation operation to exchange heat with outside air.

Once the refrigerant has been cycled through system elements in either the active water heating and heating space mode (1475) or the heating space only mode (1485), the system will determine whether the it should continue or not (1425) as noted above.

CONCLUSION

This disclosure is intended to explain how to fashion and use various embodiments in accordance with the invention rather than to limit the true, intended, and fair scope and spirit thereof. The foregoing description is not intended to be exhaustive or to limit the invention to the precise form disclosed. Modifications or variations are possible in light of the above teachings. The embodiment(s) was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled. The various circuits described above can be implemented in discrete circuits or integrated circuits, as desired by implementation.

What is claimed is:

1. A method of operating a refrigeration cycle device, comprising:

receiving refrigerant in a first state at a compressor;

compressing the refrigerant in the first state to convert the refrigerant in the first state to refrigerant in a second state;

providing the refrigerant in the second state from the compressor to a water heat exchanger;

desuperheating the refrigerant in the second state in the water heat exchanger such that heat is exchanged between the refrigerant in the second state and water to heat the water and convert the refrigerant in the second state to refrigerant in a third state;

partially condensing the refrigerant in the third state in the water heat exchanger such that heat is exchanged between the refrigerant in the second state and water to heat the water and convert the refrigerant in the third state to refrigerant in a fourth state;

fully closing an expansion valve located between the water heat exchanger and both an indoor air heat exchanger and a first port on an outdoor heat exchanger;

opening a controllable valve between the water heat exchanger and a second port on the outdoor heat exchanger;

providing the refrigerant in the fourth state from the water heat exchanger to the second port of the outdoor air heat exchanger through the open controllable valve;

performing an evaporation operation on the refrigerant in the fourth state in the outdoor air heat exchanger such that heat is exchanged between the refrigerant in the fourth state and outside air located outside a target space to heat the outside air and convert the refrigerant in the fourth state to refrigerant in a fifth state;

expanding the refrigerant in the fifth state from the outdoor air heat exchanger to convert the refrigerant in the fifth state to refrigerant in a sixth state;

providing the refrigerant in the sixth state to the indoor air heat exchanger; and evaporating the refrigerant in the sixth state in the indoor air heat exchanger such that heat is exchanged between the refrigerant in the sixth state and inside air located inside the target space to cool the inside air and convert the refrigerant in the sixth state to the refrigerant in the first state, wherein the first state, the second state, the third state, the fourth state, the fifth state, and the sixth state are all different states of the refrigerant.

2. The method of operating the refrigeration cycle device of claim 1, further comprising:

repeatedly performing the operations of receiving the refrigerant in the first state, performing the compression operation on the refrigerant in the first state, providing the refrigerant in the second state from the compressor to the water heat exchanger, desuperheating the refrigerant in the second state in the water heat exchanger, partially condensing the refrigerant in the third state in the water heat exchanger, providing the refrigerant in the fourth state from the water heat exchanger to an outdoor air heat exchanger, and fully condensing the refrigerant in the fourth state in the outdoor air heat exchanger, expanding the refrigerant in the fifth state, providing the refrigerant in the sixth state to an indoor air heat exchanger, and evaporating the refrigerant in the sixth state in the indoor air heat exchanger.

3. The method of operating the refrigeration cycle device of claim 1, wherein the refrigerant in the first state is at a temperature between 13° C. and 18° C. and at a pressure between 130 psig and 143, the refrigerant in the second state is at a temperature between 68° C. and 71° C. and at a pressure between 528 psig and 555 psig, the refrigerant in the third state is at a temperature between 59° C. and 61° C. and at a pressure between 528 psig and 555 psig, the refrigerant in the fourth state is at a temperature between 59° C. and 61° C. and at a pressure between 528 psig and 555 psig, the refrigerant in the fifth state is at a temperature between 54° C. and 56° C. and at a pressure between 528 psig and 555, and the refrigerant in the sixth state is at a temperature between 7° C. and 10° C. and at a pressure between 130 psig and 143 psig.

4. The method of operating the refrigeration cycle device of claim 1, wherein the refrigerant in the first state is at a temperature between 13° C. and 18° C. and at a pressure between 130 psig and 143 psig, the refrigerant in the second state is at a temperature between 66° C. and 69° C. and at a pressure between 340 psig and 365 psig, the refrigerant in the third state is at a temperature between 40° C. and 43° C. and at a pressure between 340 psig and 365 psig, the refrigerant in the fourth state is at a temperature between 40° C. and 43° C. and at a pressure between 340 psig and 365 psig, the refrigerant in the fifth state is at a temperature between 37° C. and 40° C. and at a pressure between 340 psig and 365 psig, and the refrigerant in the sixth state is at a temperature between 7° C. and 10° C. and at a pressure between 130 psig and 143 psig.

5. The method of operating the refrigeration cycle device of claim 1, wherein the operation of partially condensing the refrigerant in the water heat exchanger is performed by one of passing the refrigerant through an external refrigerant coil surrounding a water storage tank or passing the refrigerant through an internal refrigerant coil formed inside the water storage tank.

6. The method of operating the refrigeration cycle device of claim 1, further comprising pumping the refrigerant in the second state from the compressor to the water heat exchanger.

7. The method of operating the refrigeration cycle device of claim 1, wherein the second state is a superheated state.

* * * * *